United States Patent [19]

Risk

[11] 4,153,074

[45] May 8, 1979

[54] HYDRAULIC VALVE

[75] Inventor: Daniel W. Risk, Whittier, Calif.

[73] Assignee: Maxton Manufacturing Company, Los Angeles, Calif.

[21] Appl. No.: 733,679

[22] Filed: Oct. 18, 1976

Related U.S. Application Data

[63] Continuation-in-part of Ser. No. 332,986, Feb. 15, 1973, abandoned.

[51] Int. Cl.[2] ..... F15B 13/043

[52] U.S. Cl. ..... 137/596.12; 60/477; 91/446; 187/17; 251/63.4; 251/63.6; 137/596.14; 137/596.16

[58] Field of Search ..... 251/25, 33, 41, 44, 251/77, 63.4, 63.6, 82, 35; 187/17; 137/596.12, 596.13, 596.14, 523, 596.16; 91/27, 400, 407, 444, 446; 60/477, 478, 479, 480

[56] References Cited

U.S. PATENT DOCUMENTS

| | | | |
|---|---|---|---|
| 1,484,674 | 2/1924 | Redfield | 251/63.4 X |
| 1,710,055 | 4/1929 | Grant | 251/63.4 X |
| 2,266,415 | 12/1941 | Dinzl | 91/27 |
| 2,616,262 | 11/1952 | Driscoll | 91/392 X |
| 2,737,197 | 3/1956 | Jaseph | 137/503 X |
| 2,892,468 | 6/1959 | Beuchle | 251/77 X |
| 2,984,982 | 5/1961 | Jaseph | 91/433 |
| 3,091,932 | 6/1963 | Webb | 91/27 X |
| 3,120,880 | 2/1964 | Jaseph | 91/461 X |
| 3,141,386 | 7/1964 | Loughridge | 91/47 X |
| 3,162,092 | 12/1964 | Corwin | 91/407 X |
| 3,167,920 | 2/1965 | Fleury | 91/27 X |
| 3,330,110 | 7/1967 | Sprayberry | 91/418 |
| 3,393,508 | 7/1968 | Ray | 91/27 X |
| 3,399,689 | 9/1968 | Keane | 251/25 X |
| 3,729,020 | 4/1973 | Koli et al. | 251/63.6 X |

*Primary Examiner*—Irwin C. Cohen
*Attorney, Agent, or Firm*—Jessup & Beecher

[57] ABSTRACT

A hydraulic valve system particularly adapted for controlling a hydraulically powered elevator. The system involves essentially a bypass valve which selectively bypasses hydraulic fluid from the pump directly back to the tank during the up mode operation, thereby controlling the up speed of the elevator; and a down valve which selectively controls the escape of fluid from the elevator jack back to the tank, thereby controlling the down speed of the elevator. The down valve also serves as a check valve for retaining fluid pressure in the jack. Both the bypass valve and the down/check valve are each controlled by closely integrated cylinder-and-piston arrangement, with pressure to the cylinder being controlled by a control valve structurally interlinked to the respective piston. The bypass valve also serves as a check valve between the jack and the tank during the down mode of operation. The cylinder-and-piston control for the bypass valve makes possible an initial limit opening of the bypass valve, i.e. the valve sizing, while still permitting readjustment of the opening during the down mode, thereby allowing the bypass valve to fully open in the down mode, when it functions simply as a check valve. The entire structure is housed in a compact arrangement making optimum usage of common fluid conduit passages.

27 Claims, 21 Drawing Figures

HYDRAULIC VALVE

This application is a continuation-in-part of Serial No. 332,986, filed Feb. 15, 1973, and now abandoned, to which specific reference is now made, pursuant to 35 USC 120.

THE PREFERRED EMBODIMENTS

Figure 11:
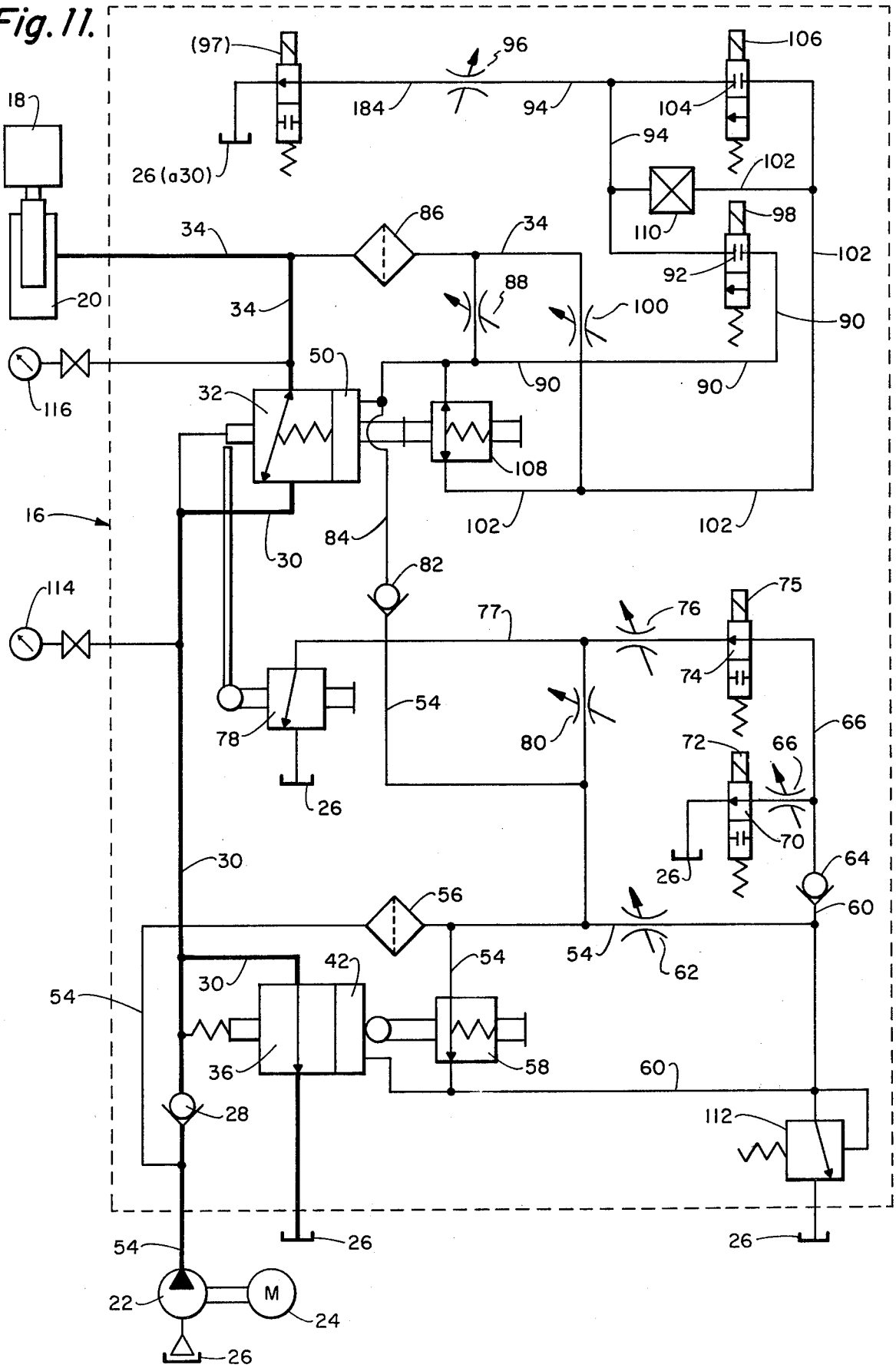
FIG. 11 is a schematic functional diagram illustrating the operation of the entire system.

Referring to FIG. 11, the valve system or structure illustrated in FIGS. 1–10 is enclosed within the dashed rectangle 16. This valve system 16 controls flow of hydraulic fluid between and among the principal parts of the elevator system, being the elevator 18, which is moved up and down by a hydraulic jack 20, a hydraulic pump 22 driven by a motor 24, and a tank or sump shown schematically at 26 throughout FIG. 11, to which hydraulic fluid is returned and from which the pump 22 draws its supply.

The pump 22 constitutes a source of hydraulic fluid such as hydraulic oil under pressure, which is applied through a check valve 28 to a conduit 30 and thence through a down/check valve 32, to the conduit 34 leading to the jack 20. The conduit or intermediate chamber 30 also leads through a bypass valve 36 back to the tank 26.

Each of the valves 32 and 36 is controlled by a fluid pressure means in the form of an expansible chamber, a wall of which forms an abutment or stop which engages the respective valve. As shown in detail in FIG. 5, this expansible chamber in each case assumes the form of a cylinder aligned with the valve in which a piston reciprocates, and a spring is compressed between the piston and the valve.

Figure 5:
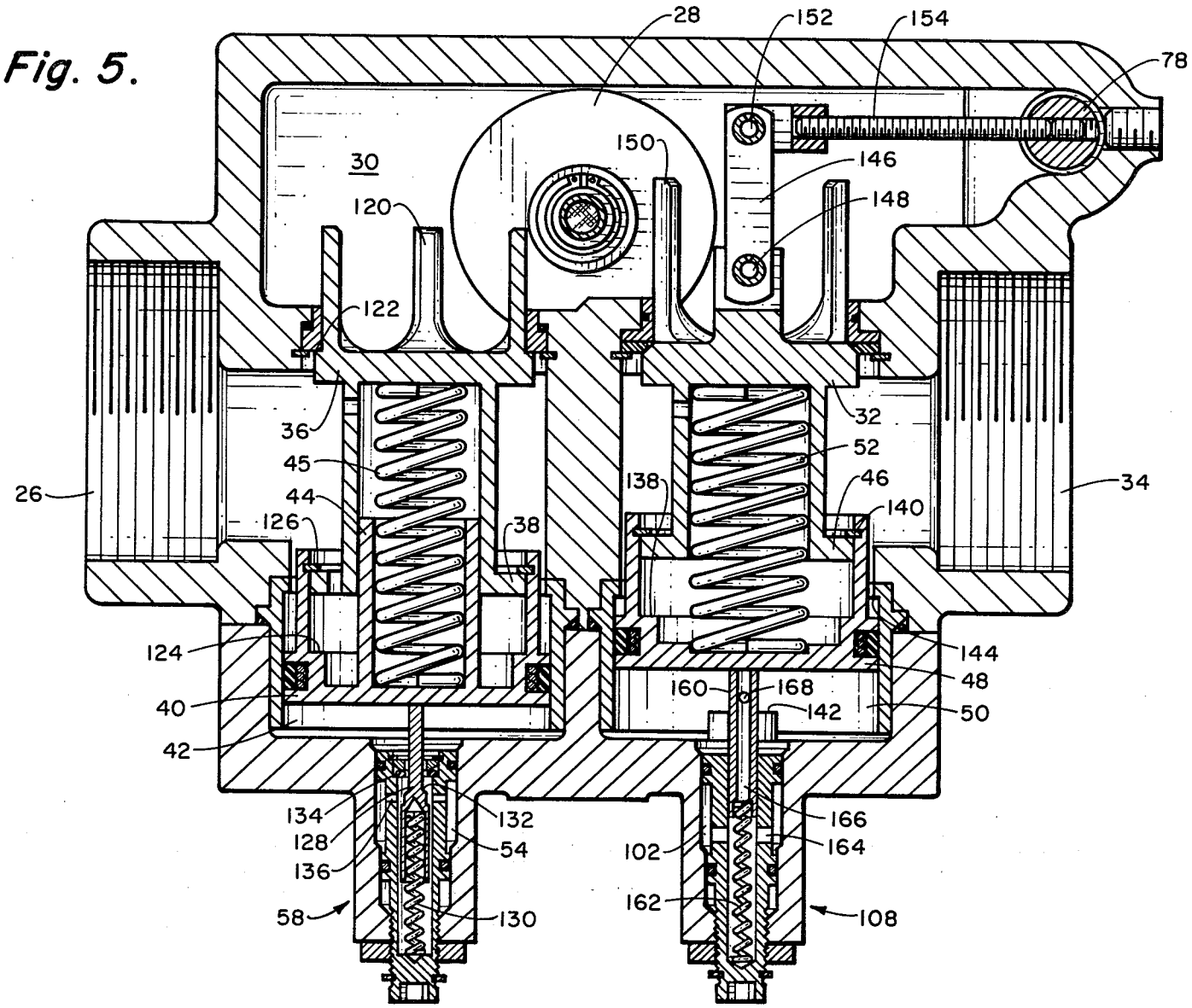
FIG. 5 is a cross-section taken on line 5—5 in FIG. 2.

Referring to FIG. 5, the bypass valve 36 has a flange 38 which reciprocates inside a bypass piston 40, which in turn reciprocates within a cylinder 42. The cylinder 42 and piston 40 together constitute the principal elements of an actuator chamber means. Further guidance for the reciprocation of the valve 36 is provided by an interior cylinder 44 formed integral with the piston 40. A spring 45 is compressed between the valve 36 and piston 40.

The down or down/check valve 32 has a flange 46 which reciprocates within a down piston 48 which in turn reciprocates in a down control cylinder 50, forming an actuator chamber means for the down valve 32. A spring 52 is compressed between the down valve 32 and piston 48.

Reverting now to FIG. 11, a conduit 54 leads directly from the output of the pump 22 through a filter 56 and thence through a sizing adjustment control valve 58 to a conduit 60 which leads to the cylinder 42. The check valve 28 isolates both the control system conduit 54 and the pump 22 from jack pressure during the down mode. The conduit 54 also leads to a conduit 60 by way of an adjustable up acceleration restriction 62. The conduit 60 leads through a check valve 64 to a conduit 66, which in turn leads to an adjustable up valve restriction 68 and through a normally open up valve 70 back to the tank 26. The valve 70 is an on-off valve actuated by a solenoid 72. The conduit 66 also leads through a normally open on-off valve 74, actuated by a solenoid 75 through an adjustable up transition restriction 76 and thence through a conduit 77 and a controlled variable up level speed valve 78 back to the tank 26.

The conduit 54 also feeds directly to the conduit 77 through an adjustable up level restriction 80 and also leads through a check valve 82 to a conduit 84 leading to the down cylinder 50.

In the down mode the jack conduit 34 applies fluid through a filter 86, and a down transition adjustable restriction 88 to a conduit 90, which leads to the down cylinder 50. The conduit 90 exhausts through a normally closed on-off down valve 92 to a conduit 94, and thence through an adjustable down acceleration restriction 96 and an optional variable restriction valve 97, to be later discussed in connection with FIG. 5A, and thence to the tank 26. The down valve 92 is operated by a solenoid 98. The conduit 34 also leads through an adjustable down stop restriction 100 to a conduit 102 which leads through a normally closed on-off down level valve 104 to the conduit 94 and thence through 96 (and 97) to the tank 26. The down levelling valve 104 is operated by a solenoid 106. The conduits 90 and 102 are connected hydraulically by a down level adjustment valve 108, which is responsive to the position of the piston 48 in the cylinder 50, in a manner which will be described hereinafter in connection with FIG. 5.

A manual lowering valve 110 is provided between the conduits 94 and 102 to allow manual down operation of the elevator in special or emergency situations. A conventional relief valve 112 is provided to relieve pressure in the conduit 60 should such pressure accidentally exceed a safe value. Access to the conduit 30 is provided for a pressure gauge 114 to measure the pressure at that point, and similar access is provided to the conduit 34 for a gauge 116.

Figure 1:
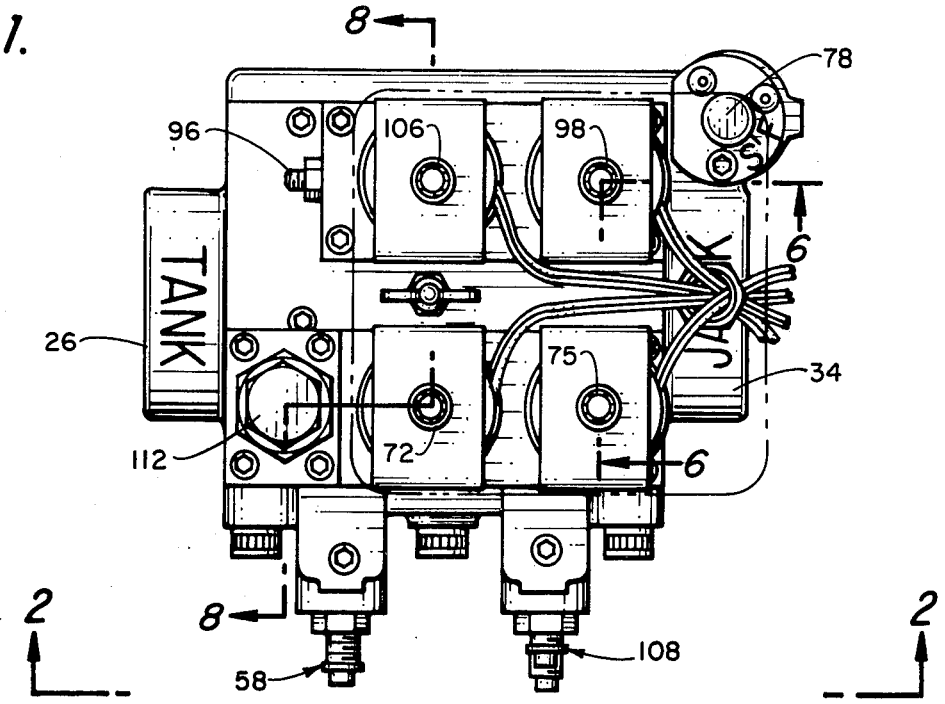
FIG. 1 is a top view of the compact valve structure of the present invention.
Figure 2:
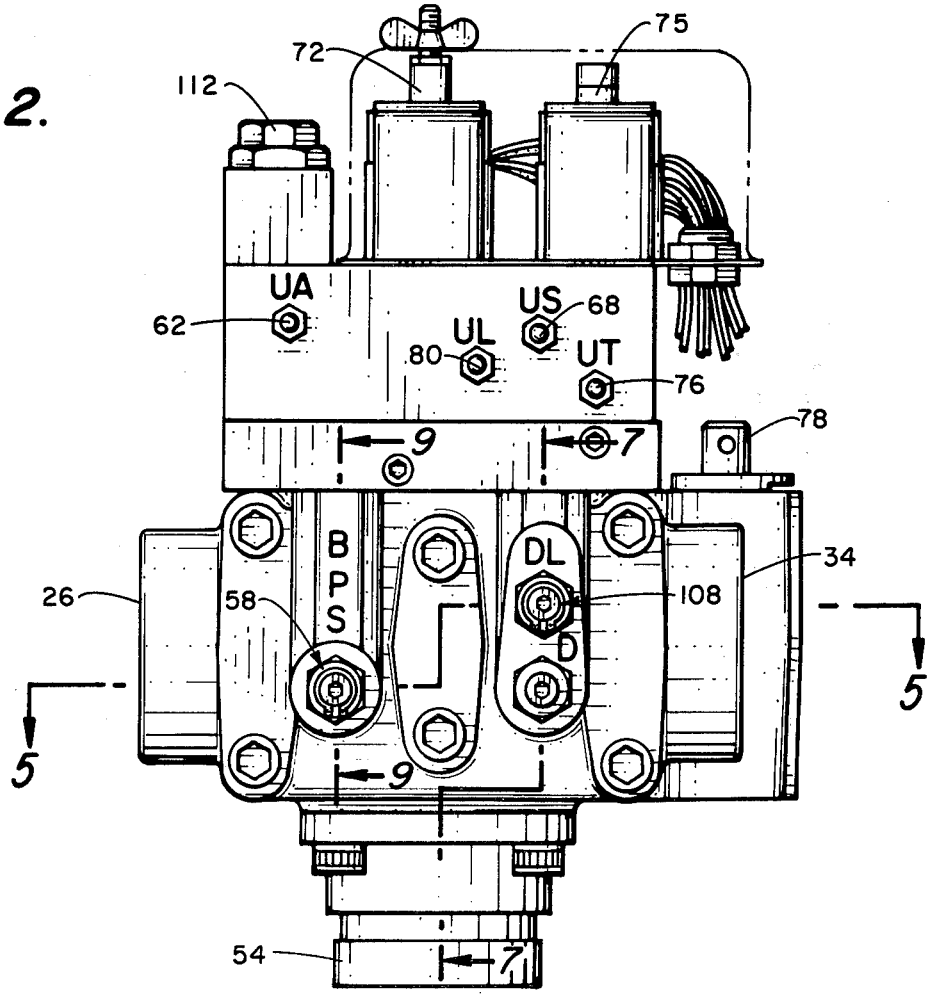
FIG. 2 is a front view taken on line 2—2 in FIG. 1.
Figure 3:
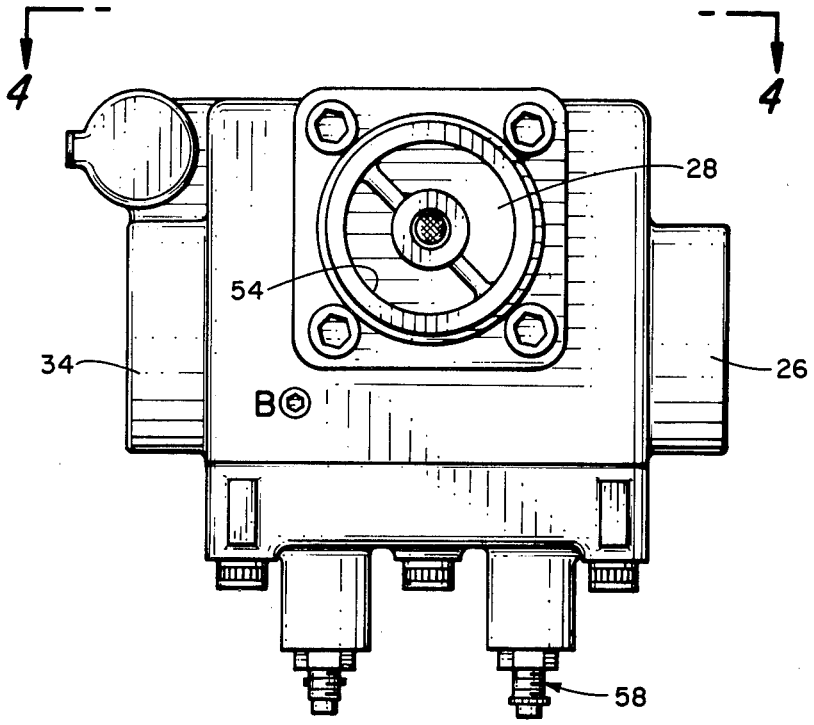
FIG. 3 is a bottom view of the valve.
Figure 4:
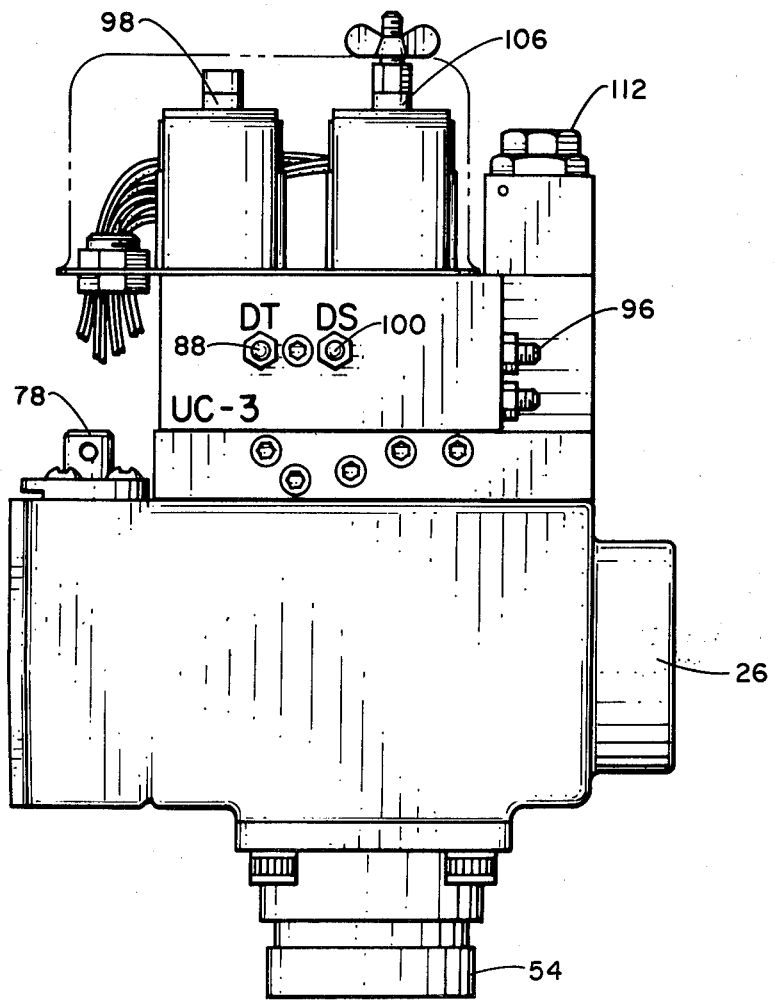
FIG. 4 is a back view taken on line 4—4 in FIG. 3.

The compact functional nature of the valve is enhanced by the configuration best seen in FIG. 2 in which the tank fitting 26 is aligned with and opposite to the jack fitting 34, with the pump fitting 54 being at right angles thereto.

THE BYPASS VALVE

The structural details of the bypass valve 36 and the down valve 32 are best seen in FIG. 5. As noted, the bypass piston 40 is guided reciprocally in its cylinder 42 and the piston in turn reciprocally guides the bypass valve 36. Further valve guidance is provided by the tangs 120 of the valve itself. The valve seats at 122 and is of the modular type wherein each incremental opening movement of the valve produces a wider openaing of the valve port. The valve 36 reciprocates within the piston 40 between a lower limit determined by a shoulder 124 and an upper limit determined by a snap ring 126.

The bypass sizing control valve 58 is structurally interlinked to the piston 40 by a mechanical follower or position sensor in the form of valve stem 128 aligned with the piston 40 and projecting through the cylinder 42 into contact with the piston face. The valve 58 is biased toward closed position by a spring 130 which biases the enlarged portion 132 of the valve stem 128 toward an O-ring 134 forming the valve seat. The valve is opened by the abutment of the piston 40 against the end of the valve stem 128. This pushes the stem downward and opens the valve port. When the valve is in open position, there is a hydraulic fluid passage open from the conduit 54 through the radial port 136, past the valve seat 134 and into the cylinder 42. When the piston 40 has raised sufficiently far to leave the stem 128, the valve 58 is closed at the annular port 132/134.

It will be noted that the area of the piston 40 exposed on both sides, that is to the cylinder 42 from below and to the conduit or chamber 26 from above, is larger than the area formed by the circumference of the valve seat 122.

THE DOWN/CHECK VALVE

The structure of the down/check valve 32 reciprocating in its piston 48 is quite similar to that of the bypass valve 36, reciprocating in its piston 40. In the case of the down valve 32, the added guidance provided at 44 for the bypass valve has been found to be unnecessary. The down valve 32 reciprocates within its piston 48 between a lower limit determined by the shoulder 138 and an upper limit determined by the snap ring 140. The limits of the piston 48 itself are determined by an adjustable stop 142 at the bottom and by an inwardly extending flange 144 at the top.

The valve 32 is structurally interlinked to the up level adjusting valve 78 by a linkage which includes a link 146 pivoted at 148 to one of the tangs 150 of the valve 32 and pivoted at 152 to an actuating arm 154 which oscillates the rotary valve 78. Thus, as the piston 32 moves up and down in FIG. 5, the arm 154 is pivoted back and forth slightly about the axis of the rotary valve 78, causing the valve 78 to turn slightly, with resultant adjustment of the port openings in the valve 78.

Like the bypass piston 40, the down piston 48 is also structurally interlinked to a control valve, in this case the down level adjustment valve 108. Valve 108 is actuated by a sleeve 160, reciprocable in alignment with the piston 48 and held in abutment with the piston 48 by the valve spring 162. The valve 108 serves to control passage of fluid between the cylinder 50 and the conduit 102 by way of the radial valve ports 164, the hollow center 166 of the sleeve 160, and radial port 168 in the sleeve 160 in communication with the cylinder 50. As the piston 48 moves down, it pushes the sleeve 160 down against the bias of the spring 162. Eventually a point is reached where the sleeve 160 begins to close off the valve ports 164 a selected amount depending on the vertical position of the sleeve 160 as determined by movement of the piston 48. The operative function of the valve 108 is performed with the valve port 164 only partially blocked; therefore leakage around the sleeve 160 is not critical.

Figure 13:
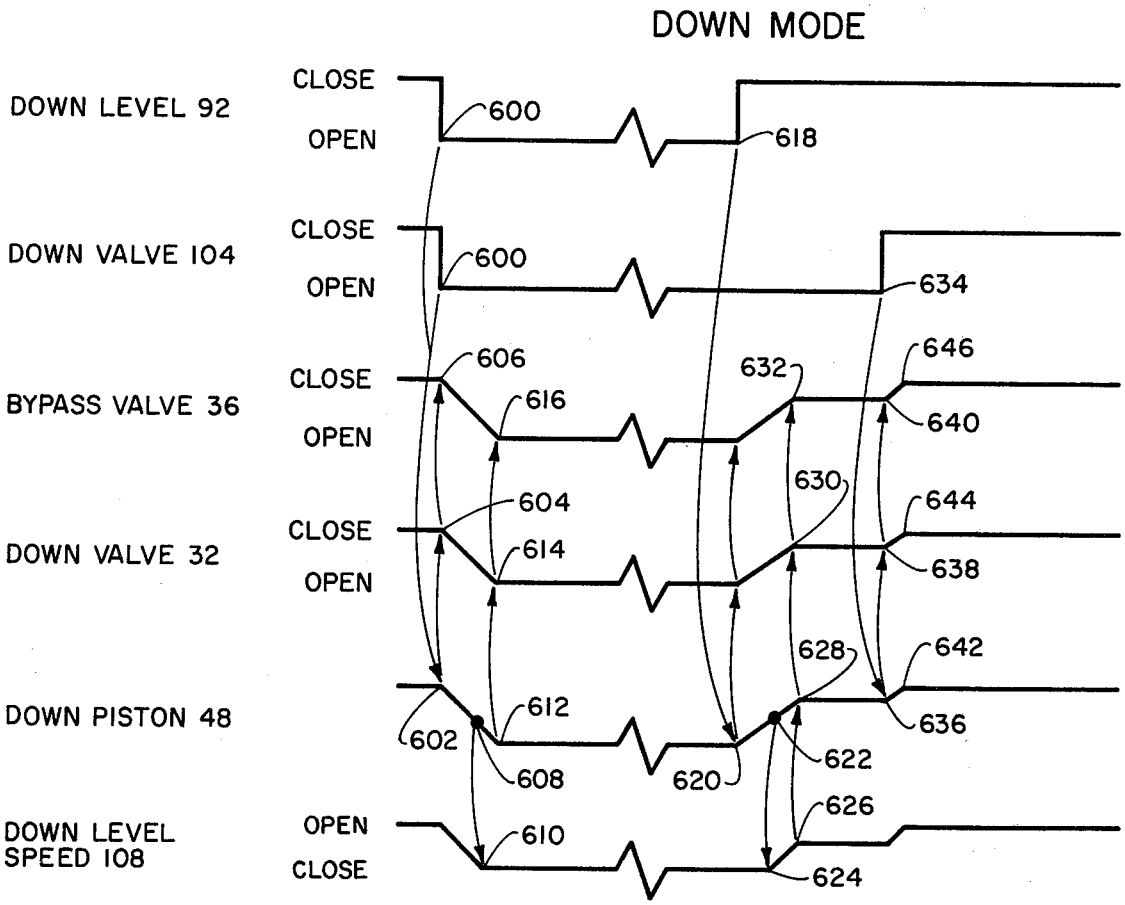
FIG. 13 is a similar timing diagram for the down mode of operation.

Operation of the valving system of this invention will now be described with particular reference to FIGS. 5 and 11 and to the timing graphs FIGS. 12 and 13.

UP MODE

Figure 12:
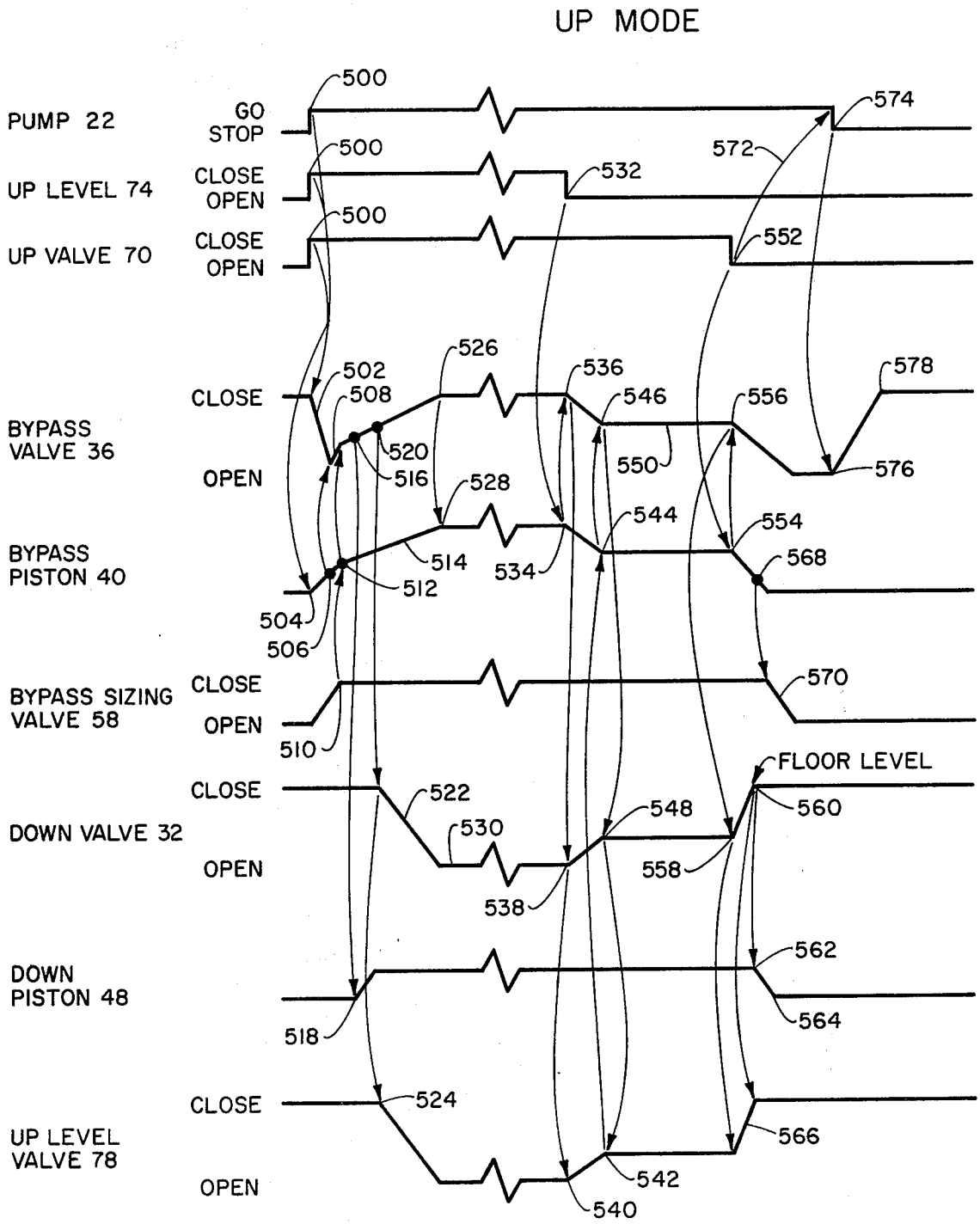
FIG. 12 is a timing diagram illustrating the time relationships in the operation of the various parts of the system in the up mode of the elevator.

Referring to FIGS. 11 and 12, at time 500 the up elevator button is pushed. This starts the pump 22 and also energizes solenoids 72 and 75, which closes their respective valves 70 and 74. This quickly builds up pressure in the conduit 30 which drives the bypass valve 36 downward against the bias of spring 45 toward its full open position, as shown by the line 502 in FIG. 12. At the same time, as shown at 504, the cylinder 42 begins to fill with fluid from the conduit 54, through the parallel paths represented by 62 and the open sizing control valve 58. This moves the bypass piston 40 upward as shown at 504. At time 506 the downward moving valve 36 encounters the stop 124 on the upward moving piston 40. Thereafter the two parts 36 and 40 move upward together as a unit and the bypass valve 36 begins to close relatively rapidly, as shown by the steep slope at 508. During this movement the valve stem 128 follows the upward movement of the piston 40 because of the bias of the spring 130. At 510 the valve shoulder 132 closes against the valve seat 134, stopping further upward movement of the stem 128 and shutting off further flow of fluid to the cylinder 42 through the sizing control valve 58. Fluid continues to fill the cylinder 42, however, but now at a reduced rate through the passage 54, 62, 60. Thus from point 512 onward, where the bypass valve 36 is partially closed, the piston and valve 40/36 move upward at a slower rate as indicated by the slope 514.

At point 516 sufficient pressure has been built up in the down cylinder 50 through parts 54, 82 and 84 to cause the down piston 48 to start to move upward, as shown at point 518. This has no effect on the down valve 32, however, merely compressing the spring 52 somewhat more. At point 520 the bypass valve 36 has closed off to the point where sufficient pressure has been built up in conduit 30 to begin to open the valve 32 now serving as a check valve, against the bias of its spring 52. Thereafter the valve 32 moves steadily downward toward full open position, as shown by the line 522. The rotational position of the up level valve 78 follows the linear movement of the valve 32 by virtue of the linkage 146/154. This is indicated at 524, but in this portion of the cycle has no particular operative significance. At point 526 the bypass valve 36 closes fully, engaging its seat 122. This stops further upward movement of the valve 36 and also of its piston 40, as shown at 528. With the bypass valve 36 fully closed, all of the fluid from the pressure source or pump 22 now flows through the fully opened down/check valve 32, shown at 530, and the elevator is now moving upward at its steady state maximum speed.

When the elevator is a preselected distance below the floor selected by the pushbutton, for example the second floor, the up level solenoid 75 is actuated by a limit switch, opening the up level valve 74 as shown at 532. This preselected distance is typically six inches for each arbitrary unit of velocity, which is typically twenty-five feet per minute. Thus, in an elevator designed for a steady state (maximum) speed of seventy-five feet per minute, the limit switch would be placed to be tripped when the elevator is eighteen inches below the floor.

Opening of 74 allows fluid to start to escape from the cylinder 42 through parts 60, 64, 66, 74, 76, 77, 78 and to the tank 26. While fluid can still enter the conduit 60 from the conduit 54 via the restriction 62, 62 is more restrictive than 76, and therefore there is a net loss of fluid pressure in the conduit 60 and hence in the cylinder 42. With loss of pressure in 42, the bypass piston 40 starts to move down, as shown at 534. This permits the valve 36 to move down also, as shown at 536. With the opening of the bypass valve 36, at 536, the resultant loss of pressure in conduit 30 is felt by the down/check valve 32, which now starts to close as shown at 538. As noted, movement of valve 32 carries along corresponding rotation of the up level valve 78 as shown at 540. This movement of the parts 40, 36, 32 and 78 continues until the up level valve 78 has closed down to the point where the fluid lost to the tank 26 through the valve 78 exactly equals the fluid being injected into the system through the restriction 62. At this point the system is in equilibrium, and stabilizes through the feedback loop represented by the points 542, 544, 546 and 548. The bypass valve 36 is now in a mid-position, represented by the level 550. A limited amount of fluid is still flowing from the pump 22 to the jack 20. This represents the levelling speed of the elevator during the levelling period, e.g. the last siz inches before attaining the preselected floor.

A fraction of an inch below the floor, another switch is actuated, de-energizing the solenoid 72 and opening the valve 70, as shown at 552. This now opens the conduit 60 directly to the tank 26 through the parts 64, 68 and 70. Fluid again starts to exit from the bypass cylinder 42, allowing the bypass piston 40 to again start downward, as shown at 554. This allows the bypass valve 36 to follow along, as shown at 556. This further opening of the bypass valve 36 further relieves pressure in 30, allowing the down valve 32 to start toward its full closed position as shown at 558.

The closing off of the down valve 32 at point 560 is substantially coincident with the elevator reaching the floor level and coming to a stop. With closure of valve 32 there is jack pressure on both sides of the piston 48, i.e. conduit 34 and cylinder 50. At this point the bias of spring 52 comes into play and starts the down piston 48 moving downward, as shown at 562. At 564 the down piston 48 resumes its rest position against the stop 142.

In the meantime the up level valve 78, being linked by the linkage 146/154 to the down piston 32, has resumed its closed position as shown by the sloping line 566.

As the bypass piston 40 moves downward, it picks up the valve stem 128 at point 568 and moves the bypass sizing valve 58 back to its open position, as shown at 570.

A predetermined, but very brief, time after the opening of the up valve 70, as shown by the arrowed line 572, the pump 22 stops at 574. Relief of pressure in the conduit 30 now allows the bypass valve 36 to close, as shown at 576. At point 578 the bypass valve has closed completely, and all components have resumed their quiescent or relaxed position as before the start of the up mode.

DOWN MODE

The down mode of operation will now be described with particular reference to FIGS. 13, 11 and 5.

It will be assumed that the elevator is at the second floor and the button for the first floor is now pushed. The pump 22 is not operating nor does it operate at any time during the down mode. Pushing the button energizes solenoids 98 and 106 and opens their respective valve 92 and 104, as shown at 600. This relieves pressure in the cylinder 50 by allowing fluid to flow from 50 through the parts 90, 92, 94, 96 (and 97) to the tank 26. There is also a parallel relief path through 50, 108, 102, 104, 94, 96 (and 97) and 26. Relief of pressure in 50 allows the piston 48 to move downward, with consequent downward movement of the valve 32. This is shown at points 602 and 604. As valve 32 opens, fluid enters conduit 30 and opens valve 36, which now serves as a check valve by virtue of its bias spring 45. The opening of valve 36 is shown at point 606.

As the down piston 48 moves down from point 602, it pushes the sleeve 160 ahead of it, thereby driving the control valve 108 toward its closed position. At point 608 the sleeve 160 has been moved down to completely cover the ports 164 and the valve 108 is closed as shown at 610. While this blocks the ultimate escape path through valve 108 for fluid from the cylinder 50, there is no significant change in the downward course of the piston 48, because the escape rate is governed principally by the restriction 96 (and 97) which affects both of the parallel escape paths. The down piston 48 therefore continues its downward course until it abuts the physical stop 142, at which point 612 further movement stops. This, of course, brings about a corresponding limiting in the open position of the down valve 32, as shown at 614. With the down valve opening thus determined, the opening of the bypass valve 36 is also stabilized, as shown at 616. The elevator is now moving downward at its maximum steady state speed.

At a predetermined distance above the preselected floor, e.g. the first floor, a limit switch is tripped, which de-energizes solenoid 98 with resultant closing of valve 92, as shown at 618. With the closing of 92, escape of fluid from the cylinder 50 is now limited to the (closed) path through the control valve 108. Since fluid is constantly entering the control system from the jack through the restriction 88, the down piston 48 begins to move upward, as shown at 620. At point 622 the sleeve control valve 108 starts to open, as shown at 624. At point 626 the sleeve valve 108 has opened wide enough the drain off all of the fluid flowing to the conduit 90 through the restriction 88, thus stablizing the pressure in the piston 50. This stops further upward movement of the down piston 48, as shown at 628, with resultant stabilizing of the down valve 32 at point 630. With the stabilizing of valve 32, the bypass valve 36 correspondingly stabilizes at a mid-position as shown at 632. The reduced, down-levelling speed is now established and persists until the elevator attains a position just a fraction of an inch above the first floor.

At this point another limit switch is tripped, which closes the down level valve 104, as shown at 634. This now closes off all escape of fluid from the cylinder 50. Continued in-flow from the jack through restriction 88 now starts the down piston 48 again moving upward as shown at 636, with consequent further closure of the down valve 32 as shown at 638, and corresponding movement of the bypass valve as shown at 640. The down piston 48 moves up to its stop position at 144, as shown at 642; the down valve 32 closes fully as shown at 644, and the bypass valve 36 likewise closes fully as shown at 646. The system is now stabilized and in quiescent condition with the elevator at the first floor.

The term sizing is used to indicate the starting position or port opening of the bypass valve just before the valve starts to close in the up mode of operation. Mechanical sizing can be used to limit the port opening of the bypass valve at the start of its up mode closure, but when that is done the port opening is unduly small for the down mode, when the bypass valve must open quite wide, because in the down mode the bypass valve is simply a check valve, and preferably is not employed to restrict the down flow of hydraulic fluid.

The hydraulic sizing of the present invention allows the bypass valve to be "sized" hydraulically, that is, brought quickly to a partially closed position and then closed off steadily in the up mode, while still permitting the bypass valve to open fully in the down mode when it serves only a check valve function.

If desired, the steady state maximum down speed may be more closely controlled than by merely relying on the adjustment of the restriction 96. This may be done as shown in FIG. 5A by positioning a valve 97 substantially similar to the sizing control valve 58, in the wall of the valve system so as to be actuated by the bypass valve 36.

Figure 5A:
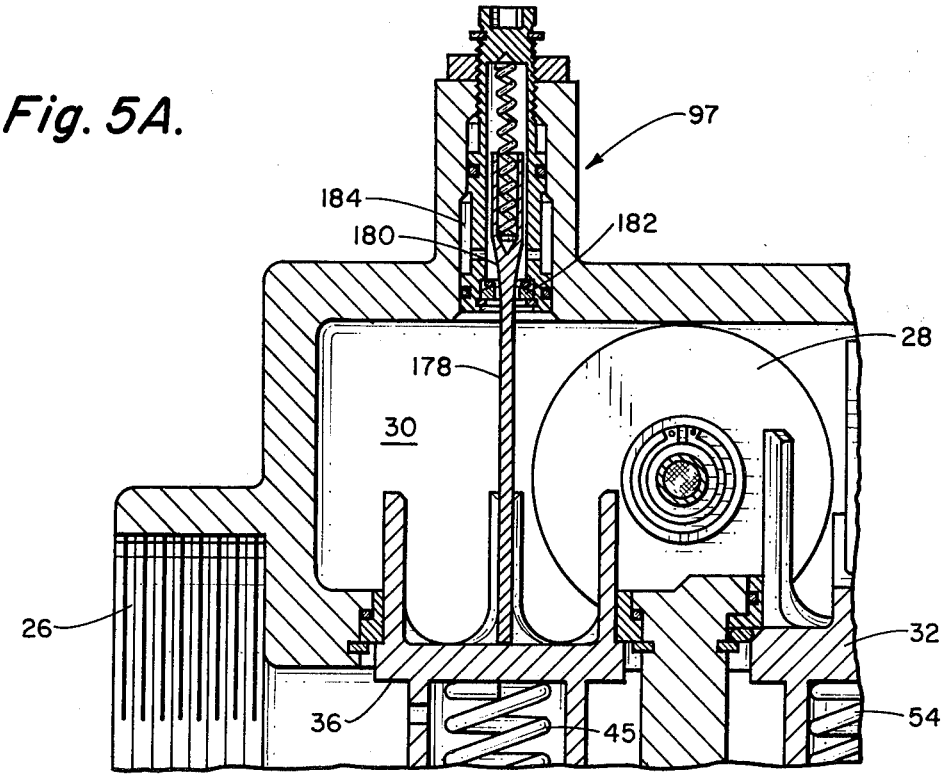
FIG. 5A is a fragmentary section illustrating a variant of FIG. 5.
Figure 6:
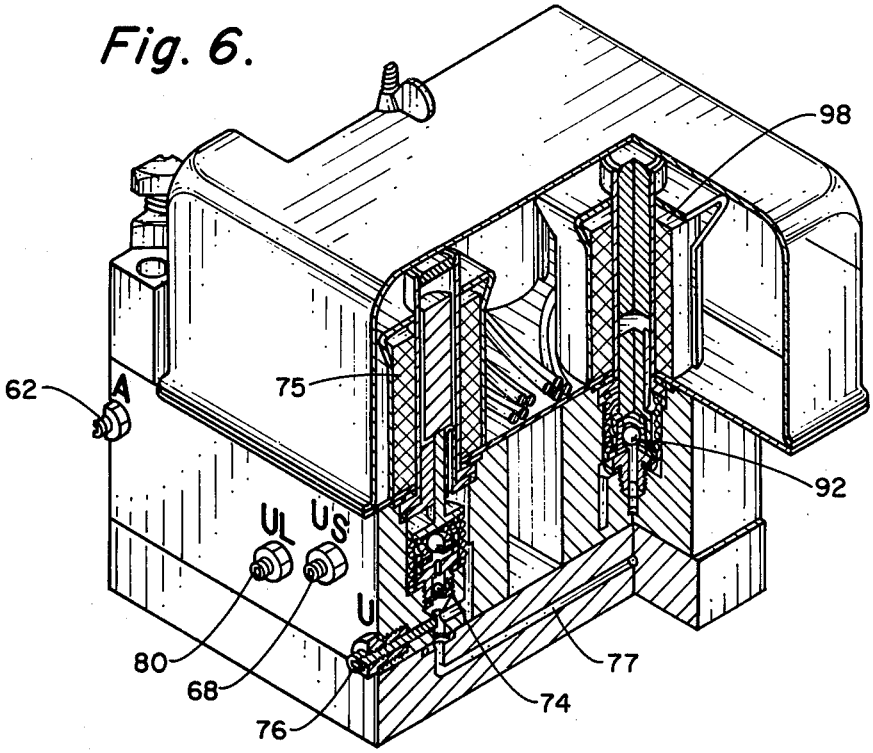
FIG. 6 is a sectioned perspective taken along line 6—6 in FIG. 1.
Figure 7:
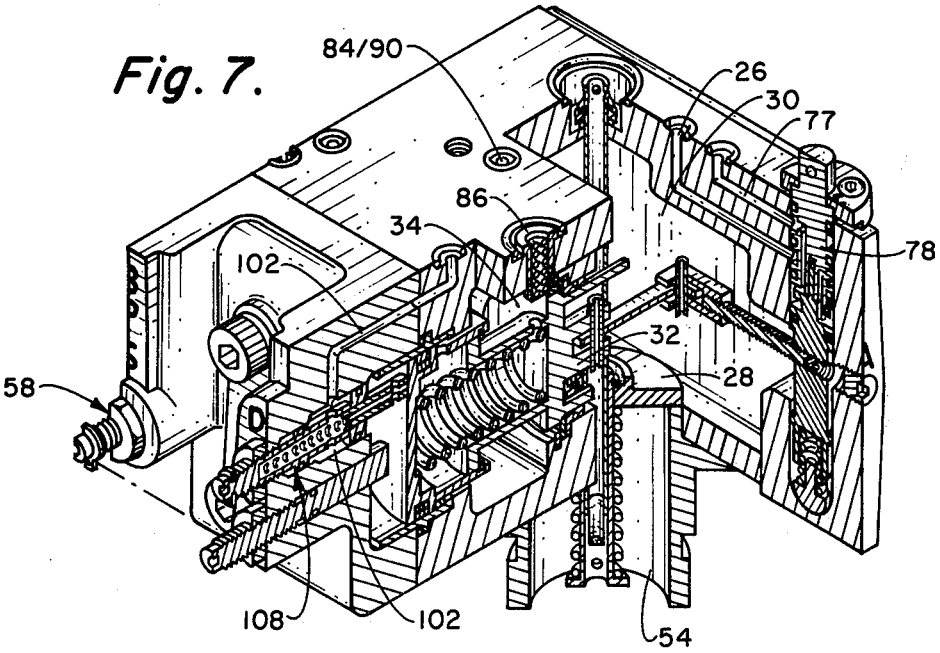
FIG. 7 is a sectioned perspective taken along line 7—7 in FIG. 2.
Figure 8:
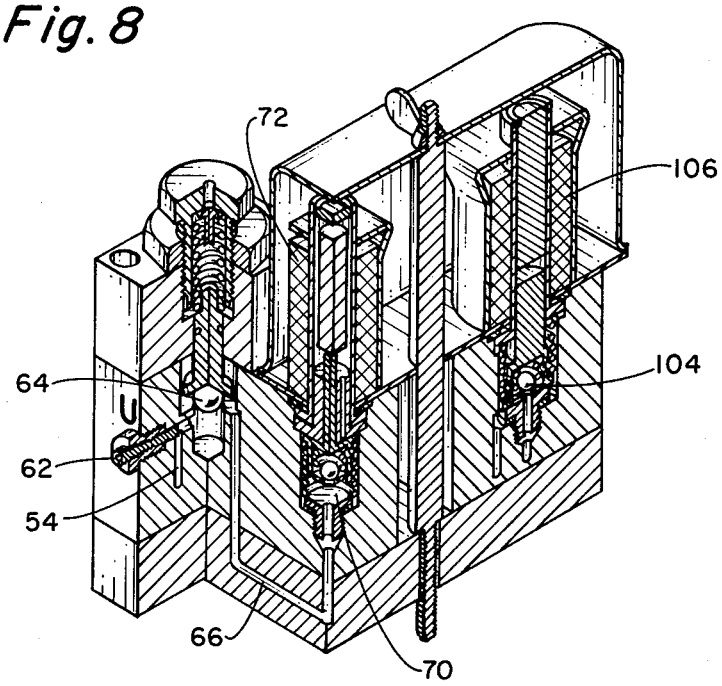
FIG. 8 is a sectioned perspective taken on line 8—8 in FIG. 1.
Figure 9:
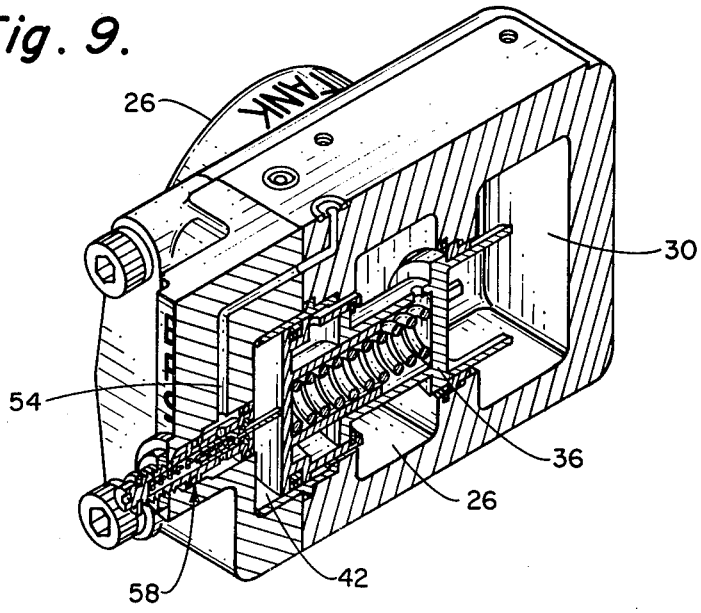
FIG. 9 is a sectioned perspective taken on line 9—9 in FIG. 2.
Figure 10:
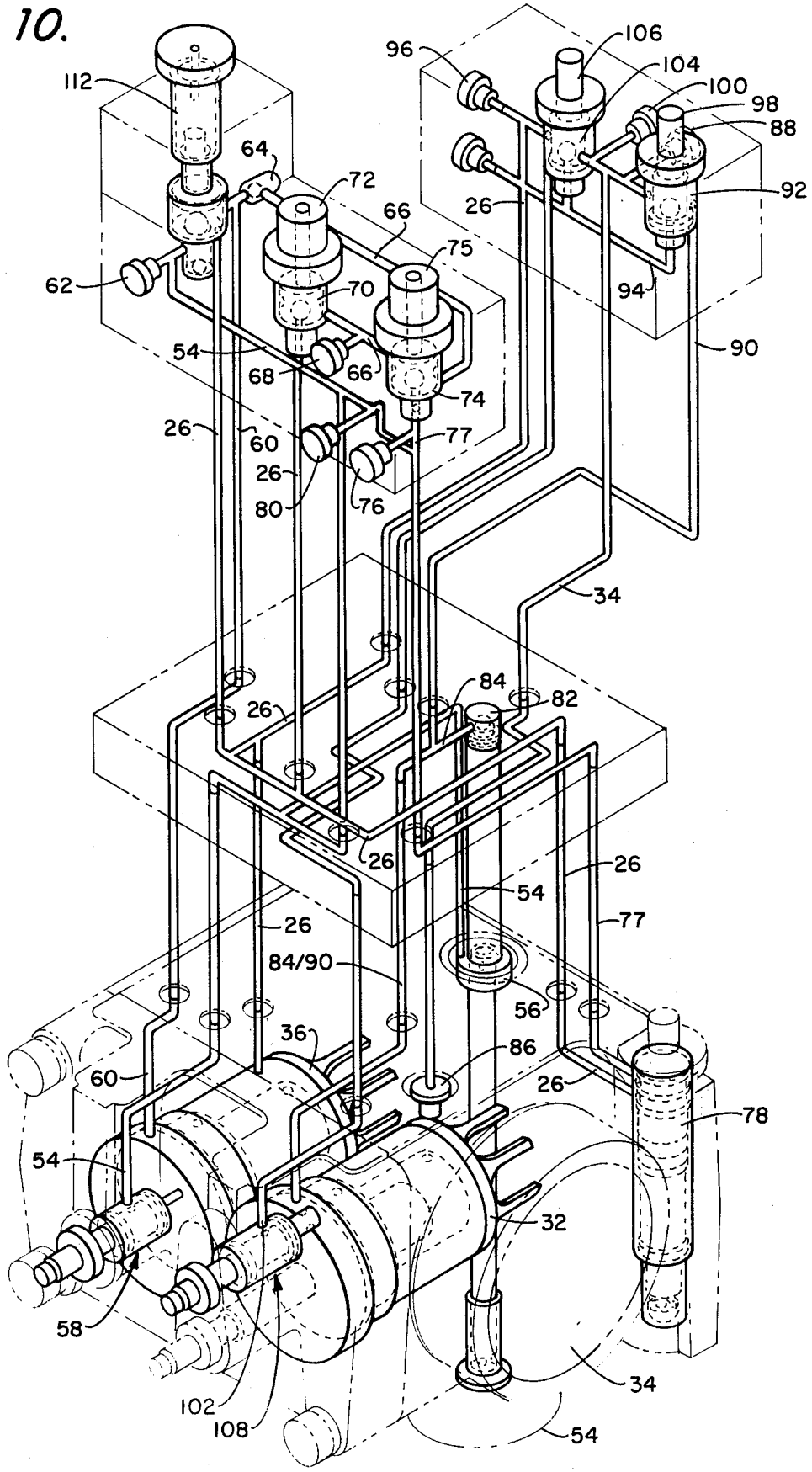
FIG. 10 is an exploded structural view emphasizing particularly the hydraulic fluid passages and valves.

The valve stem 178 is made long enough, as shown in FIG. 5A, to abut against the bypass valve 36, and the stem enlargement is made in the form of a long taper as shown at 180, thereby creating a modular effect in which the annular valve port 182 instead of being closed off abruptly, is gradually closed off as the bypass valve 36 opens up. The annular chamber of the valve is connected to the conduit 184, being the down side of the restriction 96, and the other side of the valve empties into the conduit 30, as shown in FIG. 5A in lieu of opening directly into the tank 26, as shown in FIG. 5. However, the pressure differential between 30 and 26 in this mode of operation is sufficiently small that there is no perceptible difference in function, whether the valve 97 empties into 30 or into 26.

With the modification shown in FIG. 5A, the maximum steady state down speed can be adjusted to a constant value irrespective of operating conditions, because the bypass valve 36, serving as a check valve in the down mode, acts as a speed sensor. If there is an increase in down mode fluid flow, the resulting incremental increase in bypass valve opening produces a compensating restriction in the annular valve orifice 182, which is reflected back to the down valve 32 via the down piston 48.

With operation of the FIG. 5A modification, the full down speed position of the down piston 48, instead of being against the fixed stop 142, is a variable position controlled by the volume of fluid in the cylinder 50, similar to the manner in which the valve 78 controls the up level speed position of the piston 40.

Figure 14:
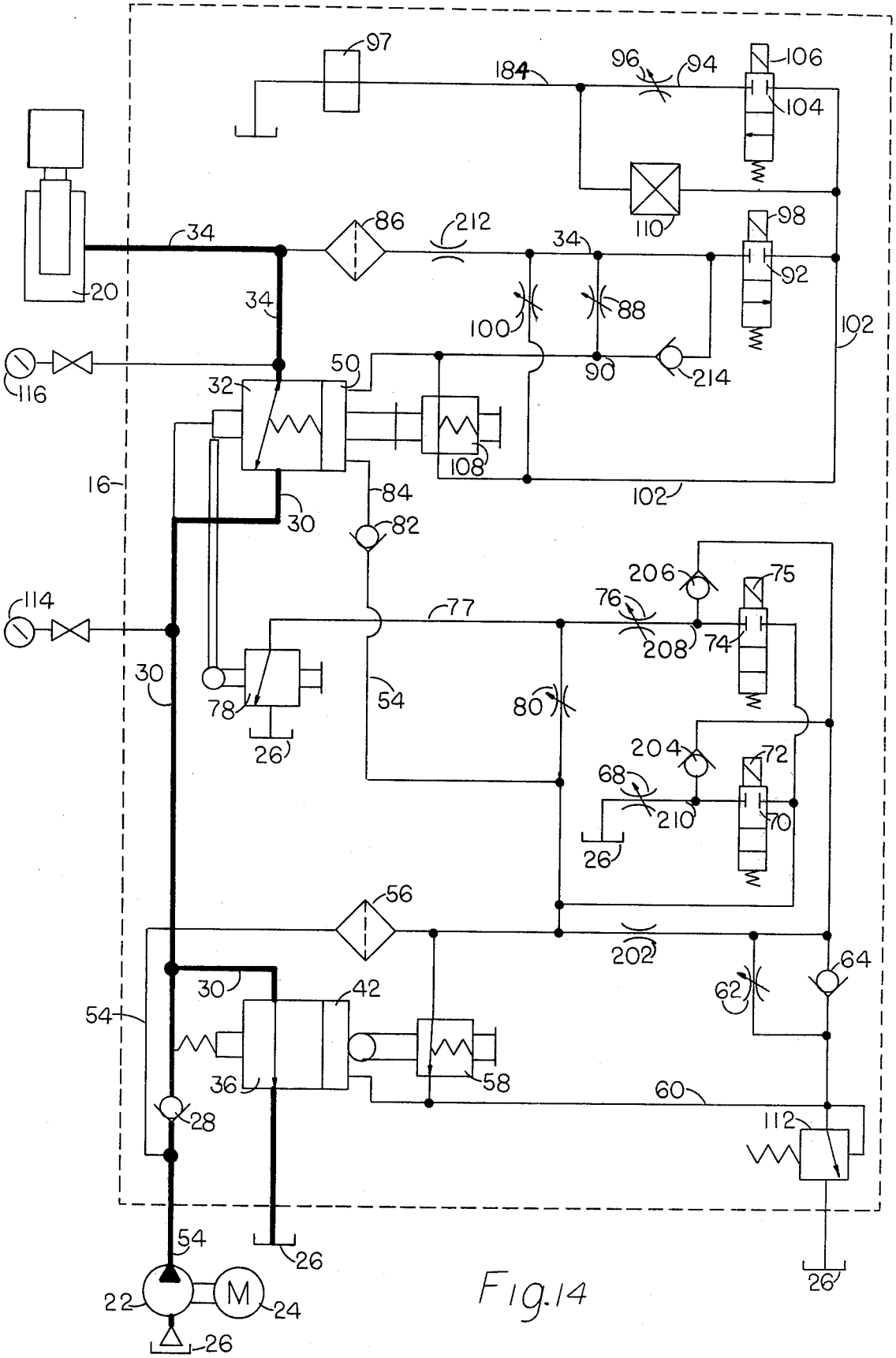
FIG. 14 is a schematic functional diagram illustrating a modification of the system.

FIG. 14 illustrates schematically the system with certain modifications in the valving and with the addition of certain check valves which bring about substantially complete isolation of the various control adjustments in the system, so that given modes of operation can be selectively adjusted without simultaneously and undesirably affecting other modes of operation. That is, the adjustments are now independent of each other, and hence easier and more precise total adjustment of the system is possible.

The modification of FIG. 14 also provides a design in which far less solenoid power is required to actuate certain of the externally operable valves.

Reverting now to FIG. 14, a conduit 54 leads directly from the output of the pump 22 through a filter 56 and thence through a sizing adjustment control valve 58 to a conduit 60 which leads to the cylinder 42. The check valve 28 isolates both the control system conduit 54 and the pump 22 from jack pressure during the down mode. The conduit 54 also leads to a conduit 60 by way of a fixed maximum up acceleration orifice 202 and an adjustable up acceleration restriction 62. The conduit 60 leads through a check valve 64 to a conduit 66, which in turn leads through a check valve 204 and thence to conduit 210 and thence to an adjustable up "stop" restriction 68 back to the tank 26. The conduit 66 also leads through an adjustable up transition restriction 76 by way of a check valve 206 through a conduit 208, and thence through a conduit 77 and a controlled variable up level speed valve 78 back to the tank 26.

The conduit 54 also feeds directly to the conduit 77 through an adjustable up level restriction 80 and also leads through a check valve 82 to a conduit 84 leading to the down cylinder 50. Additionally, the conduit 54 feeds directly to normally closed on-off valve 74 actuated by a solenoid 75, which in turn feeds the conduit 208. Conduit 54 also feeds normally closed on-off valve 70 actuated by solenoid 72 which feeds conduit 210.

In the down mode the jack conduit 34 applies fluid through a filter 86, and a fixed maximum down transition restriction 212 through an adjustable down transition restriction 88 to a conduit 90, which leads to the down cylinder 50. The conduit 90 exhausts through a check valve 214, and thence through a normally closed on-off down valve 92 to a conduit 102 through normally closed on-off valve 104, and thence through an adjustable down acceleration restriction 96 and an optional variable restriction valve 97, to be later discussed in connection with FIG. 5A, and thence to the tank 26. The down valve 92 is operated by a solenoid 98. The conduit 34 also leads through an adjustable down stop restriction 100 to a conduit 102 which leads through a normally closed on-off down level valve 104 to the conduit 94 and thence through 96 (and 97) to the tank 26. The down levelling valve 104 is operated by a solenoid 106. The conduits 90 and 102 are connected hydraulically by a down level adjustment valve 108, which is responsive to the position of the piston 48 in the cylinder 50, in a manner which will be described hereinafter in connection with FIG. 5.

A manual lowering valve 110 is provided between the conduits 184 and 102 to allow manual down operation of the elevator in special or emergency situations. A conventional relief valve 112 is provided to relieve pressure in the conduit 60 should such pressure accidentally exceed a safe value. Access to the conduit 30 is provided for a pressure gauge 114 to measure the pressure at that point, and similar access is provided to the conduit 34 for a gauge 116.

Operation of the FIG. 14 modification will now be described as before, with FIG. 14 being substituted for FIG. 11. The timing diagrams, FIGS. 12 and 13, are the same except that where FIG. 12 shows the valves 70 and 74 in closed position, they will now be in open position, and vice versa.

UP MODE

Referring to FIGS. 14 and 12, at time 500 the up elevator button is pushed. This starts the pump 22 and also energizes solenoids 72 and 75, which opens their respective valves 70 and 74. Pressure quickly builds up in conduits 208 and 210 which closes their respective check valves 206 and 204. Pressure quickly builds up in the conduit 30 which drives the bypass valve 36 downward against the bias of spring 45 toward its full open position, as shown by the line 502 in FIG. 12. At the same time, as shown at 504, the cylinder 42 begins to fill with fluid from the conduit 54, through the parallel paths represented by 62 and the open sizing control valve 58. This moves the bypass piston 40 upward as shown at 504. At time 506 the downward moving valve 36 encounters the stop 124 on the upward moving piston 40. Thereafter the two parts 36 and 40 move upward together as a unit, as shown at 508. During this movement the valve stem 128 follows the upward movement of the piston 40 because of the bias of the spring 130. At 510 the valve shoulder 132 closes against the valve seat 134, stopping further upward movement of the stem 128 and shutting off further flow of fluid to the cylinder 42 through the sizing control valve 58. Fluid continues to fill the cylinder 42, however, but now at a reduced rate through the passage 54, 62 and 60. Thus from point 512 onward the piston and valve 40/36 move upward at a slower rate as indicated by the slope 514.

At point 516 sufficient pressure has been built up in the down cylinder 50 through parts 54, 82 and 84 to cause the down piston 48 to start to move upward, as shown at point 518. This has no effect on the down valve 32, however, merely compressing the spring 52 somewhat more. At point 520 the bypass valve 36 has closed off to the point where sufficient pressure has been built up in the conduit 30 to begin to open the valve 32 now serving as a check valve, against the bias of its spring 52. Thereafter the valve 32 moves steadily downward toward full open position, as shown by the line 522. The rotational position of the up level valve 78 follows the linear movement of the valve 32 by virtue of the linkage 146/154. This is indicated at 524, but in this portion of the cycle has no particular operative significance. At point 526 the bypass valve 36 closes fully, engaging its seat 122. This stops further upward movement of the valve 36 and also of its piston 40, as shown at 528. With the bypass valve 36 fully closed, all of the fluid from the pressure source or pump 22 now flows through the fully opened down/check valve 32, shown at 530, and the elevator is now moving upward at its steady state maximum speed.

When the elevator is a preselected distance, e.g. six inches, below the floor selected by the pushbutton, for example, the second floor, the up level solenoid 75 is actuated (de-energized) by a limit switch, closing the up level valve 74, as shown at 532.

Closing of 74 allows fluid to start to escape from the cylinder 42 through parts 60, 64, 66, 206, 76, 77, 78 and to the tank 26. While fluid can still enter the conduit 66 from the conduit 54 via the restriction 202, 202 is more restrictive than 76, and therefore there is a net loss of fluid pressure in the conduit 60 and hence in the cylinder 42. With loss of pressure in 42, the bypass piston 40 starts to move down, as shown at 534. This permits the valve 36 to move down also, thus opening up as shown at 536. With the opening of the bypass valve 36, at 536, the resultant loss of pressure in conduit 30 is felt by the down/check valve 32, which now starts to close as shown at 538. As noted, movement of valve 32 carries along corresponding rotation of the up level valve 78 as shown at 540. This movement of the parts 40, 36, 32 and 78 continues until the up level valve 78 has closed down to the point where the fluid lost to the tank 26 through the valve 78 exactly equals the fluid being injected into the system through the restriction 202. At this point the system is in equilibrium, and stabilizes through the feedback loop represented by the points 542, 544, 546 and 548. The bypass valve 36 is now in a mid-position, represented by the level 550. A limited amount of fluid is still flowing from the pump 22 to the jack 20. This represents the levelling speed of the elevator during the levelling period, e.g. the last six inches before attaining the preselected floor.

A fraction of an inch below the floor, another switch is actuated, de-energizing the solenoid 72 and closing the valve 70, as shown at 552. This now opens the conduit 60 directly to the tank 26 through the parts 64, 204, 68. Fluid again starts to exit from the bypass cylinder 42, allowing the bypass piston 40 to again start downward, as shown at 554. This allows the bypass valve 36 to follow along, as shown at 556. This further opening of the bypass valve 36 further relieves pressure in 30, allowing the down valve 32 to start toward its full closed position as shown at 558.

From this point on the operation is the same as described hereinbefore in connection with FIG. 11.

DOWN MODE

The down mode of operation will now be described with particular reference to FIGS. 13, 14 and 5.

It will be assumed that the elevator is at the second floor and the button for the first floor is now pushed. The pump 22 is not operating nor does it operate at any time during the down mode. Pushing the button energizes solenoids 98 and 106 and opens their respective valves 92 and 104, as shown at 600. This relieves pressure in the cylinder 50 by allowing fluid to flow from 50 through the parts 90, 214, 92, 102, 104, 94 and 96 (and 97) to the tank 26. There is also a parallel relief path through 50, 108, 102, 104, 94, 96 (and 97) and 26. Relief of pressure in 50 allows the piston 48 to move downward, with consequent downward movement of the valve 32. This is shown at points 602 and 604. As valve 32 opens, fluid enters conduit 30 and opens valve 36, which now serves as a check valve by virtue of its bias spring 45. The opening of valve 36 is shown at point 606.

As the down piston 48 moves down from point 602, it pushes the sleeve 160 ahead of it, thereby driving the control valve 108 toward its closed position. At point 608 the sleeve 160 has been moved down to completely cover the ports 164 and the valve 108 is closed as shown at 610. While this blocks the ultimate escape path through valve 108 for fluid from the cylinder 50, there is no significant change in the downward course of the piston 48, because the escape rate is governed principally by the restriction 96 (and 97) which affects both of the parallel escape paths. The down piston 48 therefore continues its downward course until it abuts the physical stop 142, at which point 612 further movement stops. This, of course, brings about a corresponding limiting in the open position of the down valve 32, as shown at 614. With the down valve opening thus determined, the opening of the bypass valve 36 is also stabilized, as shown at 616. The elevator is now moving downward at its maximum steady state speed.

At a predetermined distance, e.g. six inches, above the preselected floor, e.g. the first floor, a limit switch is tripped, which de-energizes solenoid 98 with resultant closing of valve 92, as shown at 618. With the closing of 92, escape of fluid from the cylinder 50 is now limited to the (closed) path through the control valve 108. Since fluid is constantly entering the control system from the jack through the restrictions 212 and 88, the down piston 48 begins to move upward as shown at 620. At point 622 the sleeve control valve 108 starts to open, as shown at 624. At point 626 the sleeve valve 108 has opened wide enough to drain off all of the fluid flowing to the conduit 90 through the restriction 88, thus stabilizing the position of the piston 48. This stops further upward movement of the down piston 48, as shown at 628, with resultant stabilizing of the down valve 32 at point 630. With the stabilizing of valve 32, the bypass valve 36 correspondingly stabilizes at a mid-position as shown at 632. The reduced, down-levelling speed is now established and persists until the elevator attains a position just a fraction of an inch above the first floor.

From this point on the operation is the same as described hereinbefore in connection with FIG. 11.

A comparison of FIG. 14 with FIG. 11 will show that flow control to the control portion of bypass valve 36 and flow control to the valves 70 and 74 are now substantially independent of each other. That is to say, adjustment at orifice or restriction 62 will now alter only that portion of the circuit involving the valve 36, without altering flow in that portion of the circuit involving valves 70 and 74. In similar vein adjustment of the orifice 68 will only affect flow through the check valve 204 and adjustment of the orifice 76 will only affect flow through the check valve 206. The system of FIG. 14 thereby makes adjustment of the opening rate of the valve 36 substantially independent of adjustment of the closing rate of the valve 36.

Likewise, concerning the down mode portion of FIG. 14, adjustment of orifices or restrictions 88 or 100 will not affect flow through 96 to the tank or sump 26; whereas, in the system of FIG. 11, adjustment of the corresponding orifices 88 and 100 would have an affect on the flow through 96. Thus in the system of FIG. 14 the effect of adjustment at 88 and 100 can be desirably confined to the down check valve 32.

Another improvement effective in the system of FIG. 14 is that the valves 70 and 74 may employ a much lighter bias spring, and hence a smaller operating solenoid. The pump 22 starts at the same time that the solenoids are energized, so that the hydraulic pressure that the valves (and solenoids) have to work against is relatively small.

When the valves are normally closed, the springs may be relatively lightweight, because in the closed position the valves are bolstered by the pressure differential. Thus the biasing springs in 70 and 74, as employed in FIG. 14, may be relatively light, since they simply augment the normal closing force of gravity and the hydraulic system. Hence, the corresponding solenoids 72 and 75 may be equally light, with small power requirement.

In the system of FIG. 14 the provision of the fixed orifice 202 allows the system to be designed so that there is substantially the same fluid resistance from the line 54 to the line 66 as there is from the line 66 to the sump 26. This in substantial measure compensates for variation in fluid viscosity.

Similarly the fixed orifice 212 in the down system balances the fluid resistance between 34—34' and 34'–26.

Figure 15:
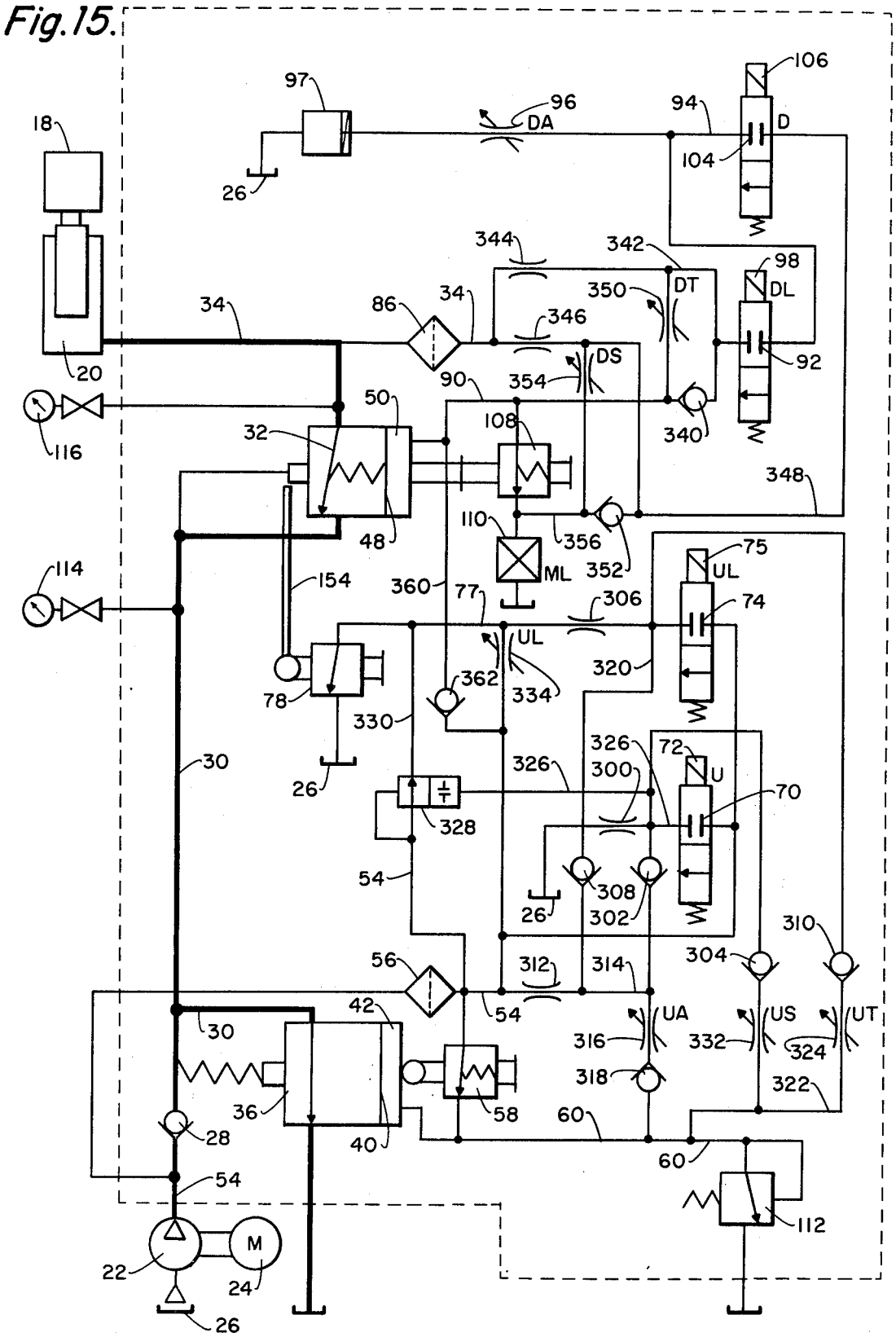
FIG. 15 is a schematic functional diagram illustrating a further modification of the system.

FIG. 15 illustrates a still further modification of the system. In this figure, where components are substantially identical and perform substantially the identical function, the same reference numeral has been carried over from earlier figures. The arrangement of parts is believed to be obvious from FIG. 15, keeping in mind the description of the other modifications shown in FIGS. 11 and 14. Any difference in structure will be obvious from the following description of operation of FIG. 15.

UP MODE

When the appropriate button is pushed, the pump 22 is started, and the solenoids 75 and 72 are energized to open their respective valves 74 and 70. The initial application of pressure to the lines 54 and 30 opens the bypass valve 36 almost to its full open position, the same as in the description of FIG. 11. At the same time pressure in the line 54 is applied unimpeded, except for fixed orifice 312, to the open valves 70 and 74. Fluid pressure through the valve 70 builds up against the relatively small fixed orifice 300, closing off or blocking the check valves 302 and 304. Similarly pressure through the valve 74 builds up against the relatively small fixed orifice 306, closing off the check valves 308 and 310.

As pressure builds up in 54, fluid flows through the fixed orifice 312 into the conduit 314, thence through the adjustable orifice 316, through the deck valve 318, conduit 60, and begins to build up pressure in the cylinder 42. This forces the piston 40 to move the bypass valve 36 toward the closed position. As the bypass valve 36 closes off, pressure builds up in line 30, and opens the down valve 32, now serving as a check valve. Fluid flows into the jack 20 and the elevator starts to move up. The bypass valve 36 steadily closes off until all of the fluid from the pump 22 is flowing into the jack 20, and the elevator is moving up at its maximum steady state speed.

A predetermined distance below the preselected floor, e.g. the second floor, a switch is tripped, which de-energizes the solenoid 75 and closes the valve 74. Closing of valve 74 lowers the pressure in the conduit 320, relieving back pressure on the check valves 308 and 310 and allowing them to be opened by pressure differential. This allows the fluid in conduit 314 to start to escape through the check valve 308 and into the conduit 320. From the conduit 320 the fluid flows through the orifice 306 to the conduit 77, thence through the valve 78 to the tank 26.

At the same time, fluid in the line 60 flows through the conduit 322, adjustable orifice 324, the now-relieved check valve 310, and into the tank 26 through the elements 320, 306, 77 and 78. Fluid escape from the conduit 60 causes the piston 40 to move the bypass valve 36 toward its open position.

Just as in the operation of FIG. 11, the opening of bypass valve 36 decreases the flow of fluid in the conduit 30 and causes a steady closing down of the check valve 32, which is linked by 154 to the up-level speed valve 78. Finally an equilibrium is achieved by the positioning of the valve 78 such that the fluid escaping from conduit 320 through 78 is exactly equal to the fluid that is flowing into the conduit 314 through the orifice 312. This condition now determines the slower speed of the elevator as it approaches the second floor, where it will stop. An inch or so, or fraction thereof, before it levels at the second floor, another trip is encountered, and this now de-energizes solenoid 72 and closes valve 70. The closing of valve 70 removes pressure from the conduit 326, taking back pressure away from the check valves 302 and 304.

Numeral 328 represents a conventional shuttle valve which functions as follows: Normally the valve is open from 54 to 330. When pressure in line 326 reaches and exceeds a certain point, the valve is closed off, so that there is no longer any passage from 54 to 330. Similarly when the pressure in 326 drops to a certain value, the path is reopened from 54 to 330.

Reverting now to the operation of the system, when pressure in 326 drops, it opens the shuttle valve 328, allowing fluid to flow from 54 to 330. Fluid now flows from 54 to 330 at a rate faster than it can escape through the valve 78 to the tank 26. This builds up pressure in 330, which is transmitted through the orifice 306 to 320, and closes off the check valves 308 and 310.

Fluid now is allowed to escape from conduit 60 through 322, adjustable up stop orifice 332, check valve 304, thence to the line 326, the fixed orifice 300 and to the tank 26. There is another path for fluid to conduit 326, and this is from the conduit 314, through check valve 302. Thus, there is a great drop of pressure in the up control system and the bypass valve 36 now opens fully.

The adjustable orifice 334 is an up-level adjusting orifice whose function is to make fine adjustments in the up-level speed, that is the last foot or two as the elevator approaches its next stop. This is done by superimposing a fluid control on the valve 78 which determines the equilibrium open position of the up-level speed valve 78. The valve 78 also has a manual adjustment which is a gross adjustment; the orifice 334 (UL) being in effect a fine adjustment.

DOWN MODE

When the elevator is ready to come down, the button is pushed and this energizes the solenoids 106 and 98, to open the valves 104 and 92, respectively.

Fluid now starts to escape from the cylinder 50 through the conduit 90, check valve 340, into the conduit 342 through the open valve 92, to the conduit 94, adjustable orifice 96, optional control 97, and to the tank 26. At the same time fluid escapes from the line 34 through the fixed orifice 344, thence to the conduit or line 342 and out as before. Fluid also escapes from the line 34 through the fixed orifice 346, into the line 348, thence through the open valve 104, and to the conduit 94.

This escape of fluid starts an opening of down valve 32, the rate of opening being controlled mainly by the orifice 96, which controls all of the several parallel escape paths for the fluid. This condition prevails until the down valve 32 is fully open, and the elevator is going down at its maximum, steady state speed. At a predetermined distance above the floor, the down level solenoid 98 is de-energized, closing the valve 92. This now confines escape of fluid from the line 34 to the line 348, through the fixed orifice 346. Fluid in 34 flows through the orifice 344, the adjustable orifice 350, then into the line 90 and the cylinder 50, moving the piston 48, to cause the down valve 32 to move toward closed position.

The down valve 32 moves steadily toward closed position until an equilibrium is attained. That is, there are two simultaneous fluid flows with respect to cylinder 50. It is receiving fluid through the conduit 90, and at the same time fluid is escaping through the conduit 108. When the valve 108 is positioned so that the amount of fluid escaping through 108 is equal to the amount of fluid coming into the cylinder 50 from the conduit 90, an equilibrium position is attained for the piston 48 and the down valve 32. This now determines the down speed at which the elevator approaches the floor from above, just prior to stopping.

An inch or so, or fraction above the floor, the down solenoid 106 is de-energized, closing the valve 104. The fluid in 348, which was previously escaping through the valve 104 is now blocked, and the consequent build-up pressure closes off the check valve 352, preventing further escape of fluid through the metering valve 108. With escape of fluid through 108 blocked, the incoming fluid from conduit 34 through elements 344, 342, 350 and 90 quickly builds up pressure in cylinder 50 and completely closes the check valve 32. If more prompt stopping is needed it can be done by opening up the adjustable orifice 354 (DS), which puts fluid from the conduit 34 directly into the conduit 356 and into the cylinder 50 through valve 108.

The conduit 360 is provided so that in the up mode there will be pressure in the cylinder 50 to insure that the valve spring 52 will be compressed to keep the valve 32 in its check position. Otherwise one could not be sure that the valve 32 would serve as a check valve. In case of accidential loss of power with consequent loss of pressure in 30 and 54, the check valve 362 in the line 360 insures that cylinder pressure is not suddenly lost.

In the embodiments shown in FIGS. 11, 14 and 15, build up of pressure when the pump 22 starts up forces fluid into the cylinder chamber 42 (through the control valve 58 and check valve 318). This moves the piston 40 so as to move the valve 36 to partially closed position, which in turn closes the valve 58, because the valve stem 128 follows the piston 40. In the FIG. 16/17 embodiment, the valve 58A is closed independently of movement of piston 40, by pressure differential between jack 20 and pump 22, as will now be explained.

As indicated hereinbefore, the purpose of the hydraulic sizing of the bypass valve 36 is to allow the bypass valve to serve effectively as a check valve in the down mode and at the same time function effectively and without undue delay to bring about optimum acceleration in the up mode. Thus in the down mode, the bypass valve 36, serving as a check valve, should open to a wide extent so as not to introduce unnecessary restriction to the escape of hydraulic fluid to the tank or sump. In the up mode 9, on the other hand, if the bypass valve 36 were to be required to start its bypass restricting action from its wide open position, there would be undue delay in applying the requisite hydraulic pressure to the jack 20, and hence undue delay in accelerating the elevator 18 in its upward traverse.

Thus, the apparatus shown in FIGS. 5 and 15 is designed to allow the bypass valve 36 to be moved quickly to partially closed position by the action of the piston or stop 40. When that partially closed position has been attained, further rapid movement of the piston or stop 40 is halted by virtue of the closing of the control valve 58. Thereafter normal, slower closing of the bypass valve 36 is effected by continued introduction of hydraulic fluid into the chamber 42, but this time only through the more restricted passage comprising the elements 54, 312, 314, 316, 318 and 60. In the operation of the apparatus shown in FIGS. 5 and 15, the bypass valve 36 attains its partially closed position at the same point, i.e. at the same amount of valve opening, irrespective of the load on the jack 20.

Figure 16:
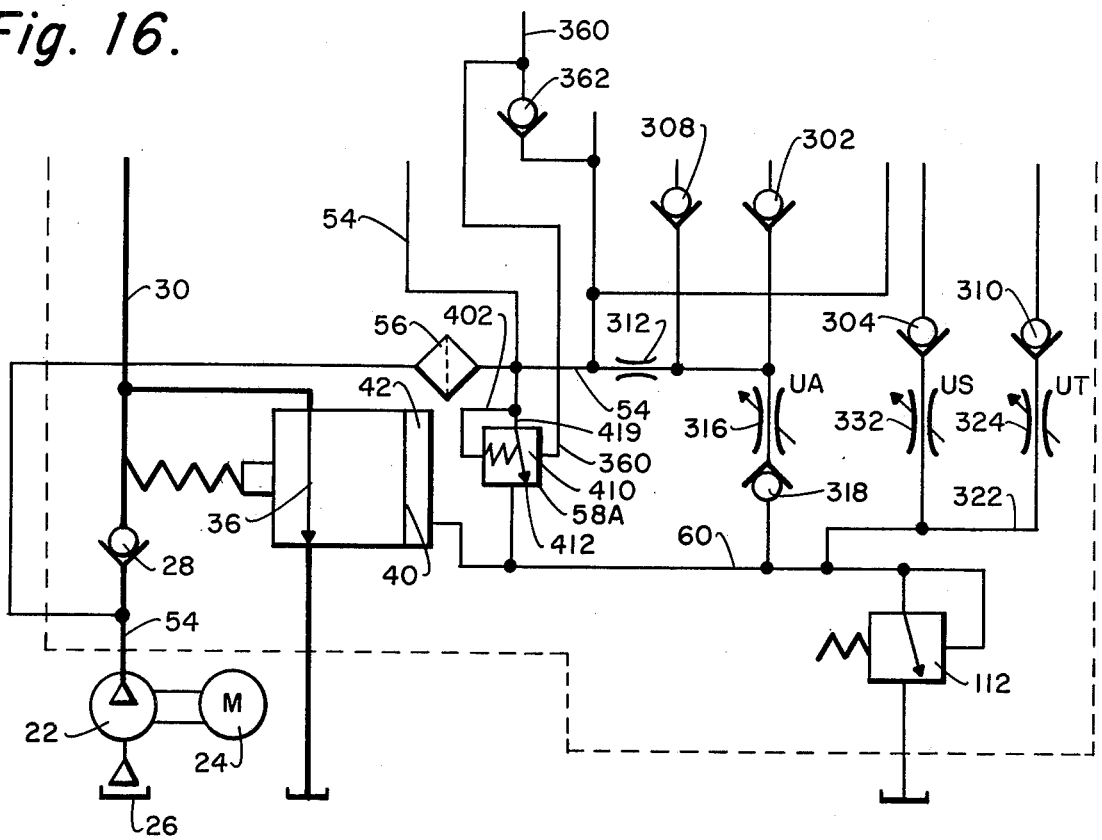
FIGS. 16 and 17 illustrate a still further modification wherein the system reacts optimally to both light and heavy elevator loads.
Figure 17:
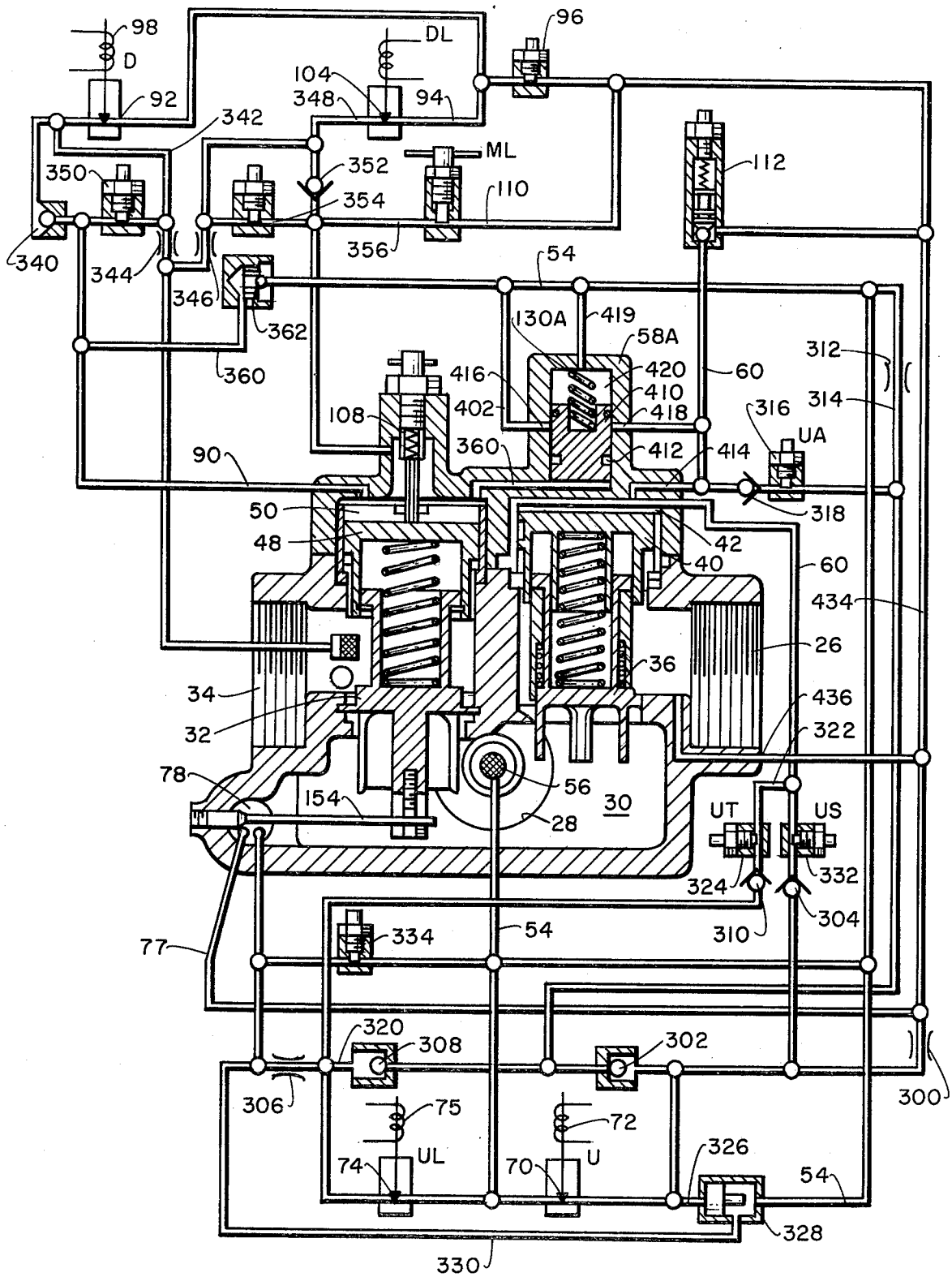

The modification shown in FIGS. 16 and 17 accomplishes the hydraulic sizing of the valve 36 in a somewhat different manner, and accommodates the system to different loads on the jack 20. When there is a heavy load on the jack 20, the up mode should start with the bypass valve 36 in a more closed position than with a light load. This allows the pump 22 to build up a higher pressure before the hydraulic sizing is completed and the up mode traverse is started.

To this end the control valve 58, instead of being actuated by the position of the movable stop 40, is controlled by balancing the pump pressure in the line 54 against the jack pressure communicated to the line 360 via the elements 34, 344, 342, 350 and 90. This is illustrated in FIG. 16 and 17 wherein the valve 58A has been substituted for the valve 58 in FIG. 15. As in the case of valve 58, the valve 58A when open provides fluid passage from the line 54 to the line 60, thereby to effect rapid pressurizing of the chamber 42 with rapid partial closing of the bypass valve 36. This is done via the lines 54, 402, port 416, valve groove 412 in valve piston 410, port 418, line 60, line 414, and thence to the chamber 42. Note FIG. 17. The valve piston or member 410 is biased toward open position by pressure in the line 360 derived, for example in FIG. 17, from the chamber 50 (which is at jack pressure). It is biased toward closed position by pressure in the line 54 (which is at pump pressure) through the line 419 and thence to the valve chamber 420. This valve closing force is supplemented by the spring 130A.

Operation in the up mode is as follows. When the pump 22 starts up, the bypass valve 36 quickly opens to full open position by virtue of buildup of pressure in the chamber 30. The valve 58A is in open position by virtue of the jack pressure residing in chamber 50 and transmitted to the bottom of valve piston 410 through the passage 360. At this time the pump pressure is relatively low. Thus, the pressure in 420, even supplemented by the spring 130A, is not sufficient to close the valve 58A. In this attitude of the valve 58A, hydraulic fluid from 54 rapidly fills chamber 42 via the elements 54, 402, 416, 412, 418 and 414. This moves the bypass valve 36 toward closed position. This rapid movement continues until pressure from the pump 22 in line 54 has built up to the point where force on the valve piston 410 exerted by pressure in chamber 420, supplemented by spring 130A, is sufficient to overcome the force on the bottom of the piston 410 exerted by jack pressure from the chamber 50. At this point, the valve piston 410 moves downward closing off the groove passage 412 and blocking further flow into the chamber 42, except through the elements 54, 312, 314, 318, 316 and 60. Flow through these elements represents the slower, up mode, filling of the chamber 42, after the hydraulic sizing has been effected. Then the bypass valve 36 slowly closes to restrict the bypass to the tank 26 and allows proper pump pressure buildup to be applied to the jack 20 and accelerate the elevator 18 upward.

The advantage of the apparatus shown in FIGS. 16 and 17 is that it automatically accommodates itself to varying loads in the elevator 18. If there is a light load at 18 (FIG. 15) the pressure from 360 at the bottom of the valve piston 410 is relatively low so that the sizing of the bypass valve 36 occurs relatively soon, because the pressure in 54 from the pump more quickly overcomes the pressure in line 360. Thus, the upmode which follows the hydraulic sizing starts at a lower pressure than with a heavy load on the elevator 18.

Conversely, a heavy load on the elevator 18 produces relatively high pressure in 360 with the consequent result that a greater pump pressure must build up in line 54 before the upmode, i.e. restricted filling of the chamber 42 through check valve 318, is instituted.

In the down mode, FIGS. 16 and 17 operate the same as heretofore described for FIG. 15.

In the valve shown in FIGS. 16 and 17 the bypass control valve 58A effects sizing of the bypass valve 36 by permitting rapid filling of the cylinder 42 until the valve is properly sized. At that point valve 58A closes so that further closing of valve 36 is effected only by admission of hydraulic fluid thru the restricted path including the elements 312, 316 and 318. Thus the control valve 58A starts in open position and moves to closed position when the valve 36 is properly sized.

The same result may be effected by causing the bypass valve to divert fluid away from the cylinder 42 when the sizing position has been reached. In this case the bypass valve starts in closed position and moves to open position when the proper pressure has been built up by the pump.

Figure 18:
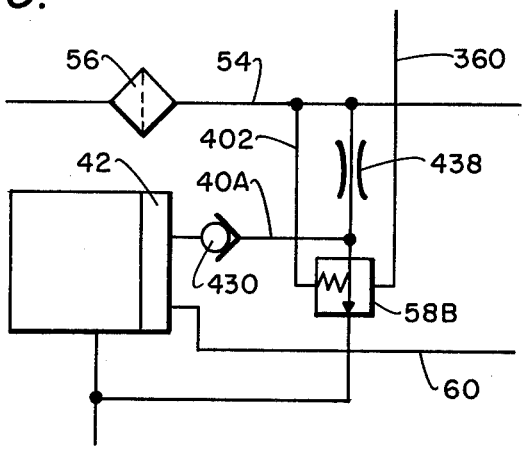
FIGS. 18 and 19 illustrate another form of the invention, being a form which incorporates the advantages of the form shown in FIGS. 16 and 17 in a different manner.
Figure 19:
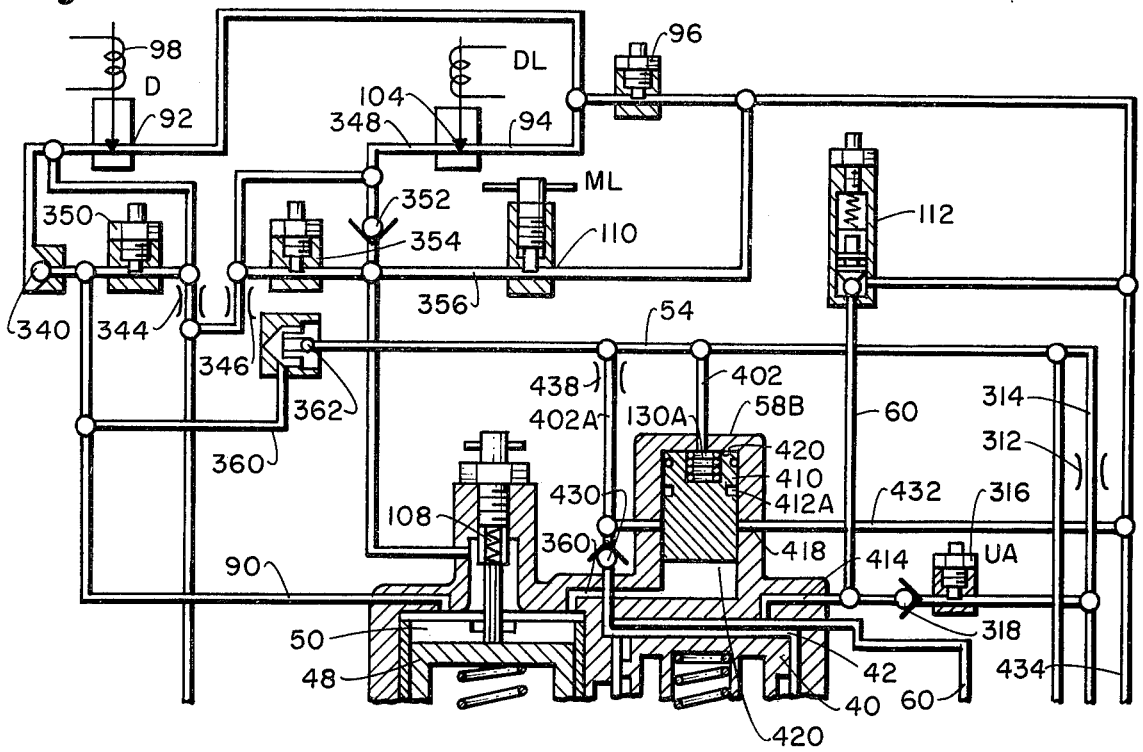

This is shown in FIGS. 18 and 19. Here the valve 58A has been replaced by a valve 58B. Like 58A, 58B is actuated by pressure differential between the pump at 402 and the jack at 360. In this case, instead of forming a part of the passage for the input of fluid to the chamber 42, the valve 58B is connected to the input side of the check valve 430, the output side of which is connected to the chamber 42. The groove 412A of the valve 58B (FIG. 19) is now positioned so that flow is cut off when the piston 410 is in raised position, i.e. when the jack pressure at 360 predominates over the pump pressure at 402. In this position the valve groove 412A is closed, and pump pressure from 54 is applied to the chamber 42 thru the check valve 430 to rapidly fill the chamber 42 up to its sized capacity. As in FIGS. 16 and 17, when pump pressure in 402 has risen sufficiently, the valve 410 moves downward (FIG. 19). This opens the groove 412A, placing the conduit 402A directly in communication with the tank 26 thru the conduit 432, 434 and 436.

There is a minor restriction 438 placed in the line 402A where it joins the line 54, which produces sufficient pressure drop at the upper or input side of the check valve 430, such that the check valve closes, blocking further ingress of fluid from the line 402A to the chamber 42. The restriction 438 is not sufficient, however, to seriously impede the rapid flow into the cylinder 42 through the open check valve 430 during the rapid sizing phase of the bypass valve. Thereafter the valve 36 proceeds with its normal bypass shutdown as in the case of the embodiments previously described.

The form of the invention shown in FIGS. 18 and 19 thus illustrates that the bypass control valve 58 may be of such nature that it either closes or opens when the bypass valve 36 has been properly sized, depending upon which point in the system the valve is interposed.

Figure 20:
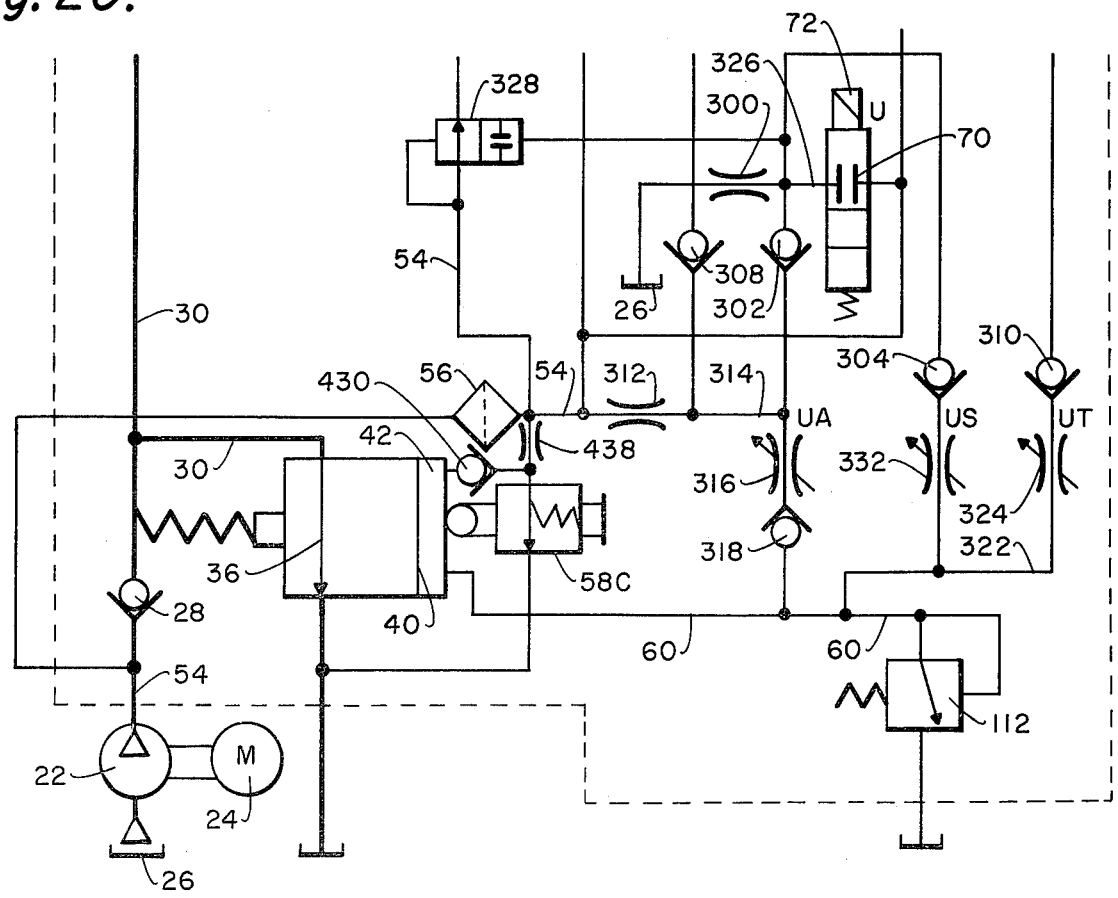
FIG. 20 is a modification of the embodiment shown in FIGS. 18 and 19.

It is clear that, as in the case of the valve shown in FIG. 5, the control valve could also be actuated indirectly by buildup of pump pressure by the position of the bypass piston 40. As shown in FIG. 20, the valve 58C is structured so that when the piston 40 reaches sized position, the valve 58C opens instead of closing, thereby diverting further flow away from the chamber 42.

Wherever a fixed orifice is called for, it is to be understood that in production this could be provided by careful sizing of the conduit, rather than by a separate, discrete element in the line or conduit.

There is thus provided a unique valve structure for hydraulically driving an apparatus, such as an elevator, in which the bypass valve is immediately moved to full open position as the pump starts up. It is then quickly sized, that is, quickly moved to a partially closed position, representing in effect the start of upward acceleration to the elevator. Thereafter the bypass valve is slowly closed down to apply increasing flow of hydraulic fluid to the jack as the elevator ascends. This is effected by driving the bypass valve with a hydraulic piston and controlling the amount of hydraulic fluid in the piston cylinder through two parallel paths. One of these paths is fixed, although adjustable, while the other is valved by a control valve which is operated by buildup of pump pressure. This buildup of pump pressure simultaneously rapidly moves the bypass valve from its full open position to its partially closed or sized position.

Actuation of the control valve is made responsive to buildup of pump pressure, either directly, by pressure differential between pump and jack, as shown in FIG. 16; or indirectly, by making the control valve responsive to the position of the drive piston, which in turn is responsive to the pressure buildup. In either case the bypass valve effectively serves (1) as a check valve in the down mode of operation and (2) as a quickly and efficiently sized bypass valve in the up mode of operation.

Another feature of this invention is that of a composite valve containing, in a compact structure, both the bypass valve and down valve; and, in the up mode, controlling the quantity of hydraulic fluid in the bypass control cylinder by means of an up levelling valve (valve 78), the position of which is mechanically controlled by the position of the down valve while such down valve is serving the function of a check valve.

Whereas the present invention has been shown and described herein in what is conceived to be the best mode contemplated, it is recognized that departures may be made therefrom within the scope of the invention, which is therefore not to be limited to the details disclosed herein, but is to be afforded the full scope of the invention.

What is claimed is:

1. Control valve structure for controlling the flow of hydraulic fluid in upward and downward directions comprising:
- a valve housing having an intermediate chamber adapted for connecting said valve structure to a hydraulic pump;
- a first chamber adapted for connecting said valve structure to a tank;
- a second chamber adapted for connecting said valve structure to a jack;
- a bypass valve between said intermediate and first chambers;
- a first, fluid-adjustable, separately movable stop member for controlling the position of said bypass valve;
- a down valve between said intermediate and second chambers;
- a second, fluid-adjustable, separately movable stop member for controlling the position of said down valve;
- first and second actuating chamber means for hydraulically controlling said first and second adjustable stop members, respectively;
- first conduit means for connecting said first actuating chamber means to said intermediate chamber;
- second conduit means for connecting said second actuating chamber means to said first chamber;
- first and second control valve means responsive to the position of said first and second stop members, respectively, for regulating the quantity of fluid in the respective said actuating chamber means;
- levelling valve means for regulating the quantity of hydraulic fluid in said first actuating chamber means; and
- mechanical actuating means connecting said levelling valve means to said down valve whereby operation of said down valve operates said levelling valve means.

2. Valve structure in accordance with claim 1 wherein said first adjustable stop member is effective to adjust the position of said bypass valve from fully closed to fully open.

3. Valve structure in accordance with claim 1 wherein said bypass valve comprises:
- a valve reciprocable on an axis;
- said actuating chamber means including,
- a piston in line with said reciprocable valve and reciprocable in a cylinder;
- said piston having a central sleeve forming a cylindrical cavity and a circumjacent hollow annulus coaxial with said axis, said reciprocable valve having a sleeve reciprocable in said annulus;
- a spring within said sleeves and compressed between said valve and piston;
- said adjustable stop member being on said piston for engaging and controlling the position of said reciprocable valve.

4. Valve structure in accordance with claim 1 wherein said bypass valve comprises:
- a reciprocable valve;
- said first actuating chamber means including,
- a piston reciprocable in an expansion chamber in alignment with said valve;
- a spring compressed between said valve and piston;
- said first adjustable stop member being on said piston for engaging and controlling the position of said bypass valve;
- said first control valve means having an activating valve stem reciprocating in alignment with, and engageable by, said piston.

5. Valve structure in accordance with claim 1 wherein said down valve comprises:
- a reciprocable valve;
- said second actuating chamber means including
- a piston reciprocable in an expansion chamber in alignment with said valve;
- a spring compressed between said valve and piston;
- said second adjustable stop member being on said piston for engaging and controlling the position of said down valve.

6. Valve structure in accordance with claim 5 wherein:

said second adjustable stop member has limits of movement to control said down valve from partially closed to fully open;

third conduit means connecting said second actuating chamber means controlling said second adjustable stop member to said second chamber for biasing said down valve toward a closed position;

fourth conduit means, including said second control valve means adapted to connect said second actuating chamber means to said first chamber for countering said bias;

whereby when the flow of hydraulic fluid in said third and fourth conduit means becomes equal, a static condition prevails in the pressure on said piston and said down valve stabilizes in a partially open position; and said second control valve means having an activating stem reciprocating in alignment with and engageable by said piston, whereby the partially open position of said down valve may be predetermined by the positional interrelationship between said control valve and said piston effected by said activating stem.

7. Valve structure in accordance with claim 1 including:

a check valve between said first conduit means and said intermediate chamber.

8. Structure in accordance with claim 1 wherein said actuation of said first control valve means constitutes an opening of said first control valve means, so that fluid is directed away from said first actuating chamber means through said first control valve means.

9. Hydraulic control valve structure for controlling a load in upward and downward directions comprising:

a valve housing having an intermediate chamber adapted for connecting said valve structure to a hydraulic pump means;

a tank chamber adapted for connecting said valve structure to a tank means;

a jack chamber adapted for connecting said valve structure to a jack means;

interconnecting means for interconnecting a pump means to said intermediate chamber to enable fluid flow from a pump means to said intermediate chamber, bypass valve means for interconnecting said intermediate chamber to said tank chamber for controlling upward movement of a load, down valve means for interconnecting said jack chamber to said intermediate chamber for controlling downward movement of a load, bypass actuating chamber means for controlling the position of said bypass valve means, conduit means for interconnecting a pump means, said actuating chamber means, and a tank means, for supplying fluid under pressure from a pump means to said actuating chamber means and for venting fluid from said actuating chamber means to a tank means, and including bypass control valve means in said conduit means for controlling the amount of fluid in said actuating chamber means thereby to control the position of said bypass valve means, mechanical follower actuating means interposed between said bypass valve means and said bypass control valve means for actuating said bypass control valve means in response to bypass valve means position, build-up of pressure from a pump means effecting movement of said bypass valve means from open to partially closed position by supplying fluid to said actuating chamber means, and also effecting actuation of said bypass control valve means via said mechanical follower actuating means to a position of said bypass control valve means wherein at said partially closed position of said bypass valve means fluid is supplied to said actuating chamber means at a rate substantially less than during said movement, thereby effecting rapid sizing of said bypass valve means in the up mode of operation.

10. Structure in accordance with claim 9 wherein said actuation of said bypass control valve means is a closing of said bypass control valve means so that fluid can no longer pass through said bypass control valve means to said first actuating chamber means.

11. Structure in accordance with claim 9 wherein said actuation of said bypass control valve means constitutes an opening of said bypass control valve means, so that fluid is directed away from said first actuating chamber means through said bypass control valve means.

12. Structure in accordance with calim 9 wherein said mechanical follower actuating means comprises abutment stem means on said bypass central valve means for sensing the position of said bypass valve means for actuating said bypass control valve means in accordance with the sensed position.

13. Structure in accordance with claim 9 wherein said interconnecting means comprises a check valve for blocking flow of fluid from said intermediate chamber to the pump means.

14. Structure in accordance with claim 9 including:

a fluid-adjustable, separately movable, stop member for controlling the position of said down valve means;

down valve actuating chamber means for hydraulically controlling said adjustable stop member;

conduit means for interconnecting said jack chamber, said down valve actuating chamber means and said tank chamber for supplying fluid under pressure from said jack chamber to said down valve actuating chamber means and for venting fluid from said down valve actuating chamber means to said tank chamber, and including down valve control valve means for controlling the amount of fluid in said down valve actuating chamber means, thereby to control the position of said adjustable stop member and thus control the position of said down valve means.

15. Structure in accordance with claim 14 wherein said down valve control valve means is controlled by the position of said adjustable stop member.

16. Structure in accordance with claim 9 wherein said bypass actuating chamber means comprises a bypass actuating cylinder and a bypass actuating piston movable therein, said piston being a physically separate part from said bypass valve means and serving as an adjustable stop limiting the degree of opening of said bypass valve means.

17. Hydraulic control valve structure for controlling a load in upward and downward directions comprising:

a valve housing having an intermediate chamber adapted for connecting said valve structure to a hydraulic pump;

a tank chamber adapted for connecting said valve structure to a tank;

a jack chamber adapted for connecting said valve structure to a jack;

interconnecting means for interconnecting a pump means to said intermediate chamber to enable fluid flow from said pump means to said intermediate chamber, bypass valve means for interconnecting said intermediate chamber to said tank chamber for controlling upward movement of the load, down valve means for interconnecting said jack chamber to said intermediate chamber for controlling downward movement of the load, bypass actuating chamber means for controlling the position of said bypass valve means, conduit means for interconnecting the pump means, said tank chamber, and said actuating chamber means for supplying fluid under pressure from the pump means to said actuating chamber means and for venting fluid from said actuating chamber means to said tank chamber and including levelling valve means for controlling the amount of hydraulic fluid in said bypass actuating chamber means; and mechanical actuating means for connecting said levelling valve means to said down valve means whereby operation of said down valve means operates said levelling valve means.

18. Control valve structure for controlling the flow of hydraulic fluid in upward and downward directions comprising:

a valve housing having an intermediate chamber adapted for connecting said valve structure to a hydraulic pump;

a first chamber adapted for connecting said valve structure to a tank;

a second chamber adapted for connecting said valve structure to a jack;

a bypass valve between said intermediate and first chambers;

a first fluid-adjustable, separately movable stop member for controlling the position of said bypass valve;

a down valve between said intermediate and second chambers;

a second fluid-adjustable, separately movable stop member for controlling the position of said down valve;

first and second actuating chamber means for hydraulically controlling said first and second adjustable stop members, respectively;

first conduit means for connecting said first and second actuating chamber means to the pump;

levelling valve means for regulating the quantity of hydraulic fluid in said first actuating chamber means; and mechanical actuating means connecting said levelling valve means to said down valve, whereby operation of said down valve operates said levelling valve.

19. Valve structure in accordance with claim 18 including:

control valve means for controlling the flow of fluid from said first conduit means to said first actuating chamber means;

whereby said first adjustable stop member restricts the opening of said bypass valve only when the pump is delivering hydraulic fluid under pressure.

20. Control valve structure for controlling the flow of hydraulic fluid in upward and downward directions comprising:

a valve housing having an intermediate chamber adapted for connecting said valve structure to a hydraulic pump;

a first chamber adapted for connecting said valve structure to a tank;

a second chamber adapted for connecting said valve structure to a jack;

a bypass valve between said intermediate and first chambers;

a down valve between said intermediate and second chambers;

a fluid-adjustable, separately movable stop member for controlling the position of said down valve;

first and second actuating chamber means for hydraulically controlling said bypass valve and said adjustable stop member, respectively;

conduit means adapted for connecting said actuating chamber means to the hydraulic pump;

first and second control valve means for controlling the fluid in the respective said actuating chamber means;

buildup of pressure from the pump effecting movement of said bypass valve to partially closed position, and also effecting closing of said first control valve means;

up levelling valve means for regulating the quantity of hydraulic fluid in said first actuating chamber means; and mechanical actuating means for connecting said levelling valve means to said down valve, whereby operation of said down valve operates said levelling valve means.

21. Control valve structure for controlling the flow of hydraulic fluid in upward and downward directions comprising:

a valve housing having an intermediate chamber adapted for connecting said valve structure to a hydraulic pump;

a first chamber adapted for connecting said valve structure to a tank;

a second chamber adapted for connecting said valve structure to a jack;

a bypass valve between said intermediate and first chambers;

a first fluid adjustable, separately movable stop member for controlling the position of said bypass valve;

a down valve between said intermediate and second chambers;

a second fluid-adjustable, separately movable stop member for controlling the position of said down valve;

first and second actuating chamber means for hydraulically controlling said first and second adjustable stop members, respectively;

conduit means adapted for connecting said actuating chamber means to the hydraulic pump;

first and second control valve means for controlling the fluid in the respective said actuating chamber means;

up levelling valve means for regulating the quantity of hydraulic fluid in said first actuating chamber means; and mechanical actuating means for connecting said levelling valve means to said down valve, whereby operation of said down valve operates said levelling valve means.

22. Structure in accordance with claim 21 wherein buildup of pressure from the pump effects movement of said first stop member to partially close said bypass valve, and also effects closing of said first control valve means.

23. Structure in accordance with claim 22 wherein said closing of said first control valve means is effected by said movement of said first stop member.

24. Hydraulic control valve structure comprising:

a housing having conduit means adapted to connect a source of fluid under pressure and a driven means operated by hydraulic pressure;

down valve means for controlling the flow of fluid from said conduit means to a driven means;

separately movable down valve abutment means for controlling said down valve means;

pressure-responsive means for moving said down valve abutment means;

down control valve means for controlling said pressure-responsive means, thereby to control said down valve abutment means;

bypass valve means for bypassing fluid from said conduit means back to a source;

said down and bypass valve means being biased open by pressure in said conduit means;

mechanical means for biasing said down and bypass valve means toward a closed position;

separately movable bypass abutment means for limiting the maximum opening of said bypass valve means when serving to bypass fluid and including expansible chamber means;

second conduit means for supplying fluid to, and venting fluid from, said expansible chamber means;

levelling valve means for regulating the fluid in said expansible chamber means;

mechanical actuating means connecting said levelling valve means to said down valve mans for operating said levelling valve means in conjunction with said down valve means; and sizing valve means in said second conduit means and controlled by the position of said movable bypass abutment means, for altering the operating of said abutment means, whereby the ultimate position of said abutment means may be predetermined by determining the control relationship between said abutment means and said valve means, thereby to control said maximum opening of said bypass valve means.

25. Structure in accordance with claim 24, including check valve means for passing fluid from a source to said conduit means and blocking fluid flow in the reverse direction;

wherein said second conduit means connects a region between a source and said check valve means to said chamber means via said sizing valve means.

26. Structure in accordance with claim 25 wherein said chamber means comprises a cylinder;

said bypass abutment means comprises a piston reciprocable in said cylinder;

said sizing valve means has a stem, the position of which is controlled by the position of said piston.

27. Structure in accordance with claim 26 wherein said bypass valve means reciprocates in alignment with said piston;

and said mechanical means includes a spring compressed between said bypass valve means and said piston.

* * * * *